US007410533B2

(12) United States Patent
Yabu

(10) Patent No.: US 7,410,533 B2
(45) Date of Patent: Aug. 12, 2008

(54) HUMIDITY CONTROLLER APPARATUS

(75) Inventor: Tomohiro Yabu, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 424 days.

(21) Appl. No.: 10/560,101

(22) PCT Filed: Jun. 10, 2004

(86) PCT No.: PCT/JP2004/008519

§ 371 (c)(1),
(2), (4) Date: Dec. 9, 2005

(87) PCT Pub. No.: WO2004/111545

PCT Pub. Date: Dec. 23, 2004

(65) Prior Publication Data

US 2007/0089608 A1 Apr. 26, 2007

(30) Foreign Application Priority Data

Jun. 11, 2003 (JP) ..... 2003-166952

(51) Int. Cl.
*F24F 3/147* (2006.01)
*F25B 17/08* (2006.01)

(52) U.S. Cl. ..... 96/127; 55/506; 62/480; 62/271

(58) Field of Classification Search ..... 96/12–128, 96/134, 135, 142; 55/350.1, 490, 495, 506; 62/93, 94, 480, 271
See application file for complete search history.

(56) References Cited

U.S. PATENT DOCUMENTS 5,179,998 A * 1/1993 Des Champs ..... 165/222
5,183,098 A * 2/1993 Chagnot ..... 165/8
5,203,989 A * 4/1993 Reidy ..... 210/137
5,230,466 A * 7/1993 Moriya et al. ..... 236/44 A
5,236,478 A * 8/1993 Lewis et al. ..... 55/319
5,595,949 A * 1/1997 Goldstein et al. ..... 502/20

(Continued)

FOREIGN PATENT DOCUMENTS

JP 60-178735 A 9/1985

(Continued)

OTHER PUBLICATIONS

CD-ROM of the Specification and drawings annexed to the request of Japanese Utility Model Application No. 94380/1991 (Laid-open No. 42925/1993), Jun. 1993.

*Primary Examiner*—Frank M Lawrence
(74) *Attorney, Agent, or Firm*—Birch, Stewart, Kolasch & Birch, LLP

(57) ABSTRACT

In a humidity controller apparatus for removing moisture from or adding moisture to process subject air which is to be supplied to an indoor space alternately using a first adsorption element (81) and a second adsorption element (82) by switching distribution routes for the process subject air in the casing (10), a suction-side wall (12) of the casing (10) has first and second inlet openings (13, 15) which are provided side by side. The casing (10) has a filter room (44) which is in communication with the first and second inlet openings (13, 15). The filter room (44) contains an air filter (71) for filtering the process subject air. With this structure, maintenance tasks for the air filter (71) are simplified.

13 Claims, 12 Drawing Sheets

U.S. PATENT DOCUMENTS

| | | | | |
|---|---|---|---|---|
| 2002/0134087 | A1* | 9/2002 | Urch | 62/3.2 |
| 2004/0000152 | A1* | 1/2004 | Fischer | 62/94 |
| 2004/0020177 | A1* | 2/2004 | Ota et al. | 55/481 |
| 2005/0160708 | A1* | 7/2005 | Iantorno | 55/482 |

FOREIGN PATENT DOCUMENTS

| | | | |
|---|---|---|---|
| JP | 4-350443 | A | 12/1992 |
| JP | 6-272891 | A | 9/1994 |
| JP | 2002-22206 | A | 1/2002 |
| JP | 2002-263434 | A | 9/2002 |
| JP | 2002-331221 | A | 11/2002 |

* cited by examiner

HUMIDITY CONTROLLER APPARATUS

TECHNICAL FIELD

The present invention relates to a humidity controller apparatus for controlling the humidity of air and specifically falls within a technical field relating to the arrangement of an air filter of the humidity controller apparatus.

BACKGROUND ART

Conventionally, a humidity controller apparatus which controls the humidity of air using an adsorbent material has been known. For example, in a humidity controller apparatus disclosed in Japanese Laid-Open Patent Publication No. 2002-22206, first and second process subject air are distributed in a hollow casing by first and second fans. In the casing, distribution routes for the process subject air are switched, and adsorption and desorption of moisture is alternately carried out by each adsorption element. In the above humidity controller apparatus, the first adsorption element and the second adsorption element are alternately used to carry out humidification and dehumidification of process subject air which is to be supplied to an indoor space.

In the above humidity controller apparatus, an air filter is generally provided in order to prevent a foreign material from intruding into a device contained in the casing. Conventionally, various structures have been employed as to the arrangement of an air filter. For example, a humidity controller apparatus wherein a suction opening provided on a side surface of a heat exchanger contained in the casing is directly covered with an air filter as in the air filter disclosed in Japanese Laid-Open Utility Model Publication No. 60-178735 has been known. With this, intrusion of a foreign material into the heat exchanger which would be greatly affected by the intrusion of a foreign material can be prevented. However, with such a countermeasure, a distribution route in the casing for process subject air which extends up to the heat exchanger is greatly affected by intrusion of a foreign material.

In the above humidity controller apparatus disclosed in Japanese Laid-Open Patent Publication No. 2002-22206, for example, any one of a pair of side walls of the casing is provided with a suction opening for introducing first process subject air and an outlet opening for expelling second process subject air, while the other side wall is provided with a suction opening for introducing the second process subject air and an outlet opening for expelling first process subject air. In the humidity controller apparatus having such a structure, it is necessary to provide an air filter in the vicinity of each suction opening as shown in, for example, Japanese Laid-Open Patent Publication No. 4-350443 in order to remove the foreign material from the process subject air at the time when the process subject air flows into the casing.

Problems To Be Solved

In general, the air filter needs to be cleaned periodically. That is, the task of taking the air filter out of the casing for cleaning and reinstalling the cleaned air filter in the casing needs to be carried out with a relatively high frequency. Thus, with the above-described structure where the air filter is placed in the casing at a distant position, maintenance of the air filter results in a very complicated procedure.

The present invention was conceived in view of the above problems. An objective of the present invention is to provide a humidity controller apparatus in which maintenance of an air filter is easily accomplished.

DISCLOSURE OF INVENTION

The first invention is directed to a humidity controller apparatus for removing moisture from or adding moisture to process subject air alternately using a first adsorption element (81) and a second adsorption element (82) by distributing first and second process subject air in a hollow casing (10) with first and second fans (95, 96) and switching distribution routes for the process subject air in the casing (10). The casing (10) has a flat rectangular shape and has first and second inlet openings (13, 15) and first and second outlet openings (14, 16). A suction-side wall (12), which is one of side walls of the casing (10), has first and second inlet openings (13, 15) which are provided side by side in a longitudinal direction of the suction-side wall (12). The casing (10) has a filter room (44) extending along the suction-side wall (12), the filter room (44) being in communication with the first and second inlet openings (13, 15). The filter room (44) contains an air filter (71) for filtering process subject air introduced through the inlet openings (13, 15).

The second invention is directed to a humidity controller apparatus for removing moisture from or adding moisture to process subject air alternately using a first adsorption element (81) and a second adsorption element (82) by distributing first and second process subject air in a hollow casing (10) with first and second fans (95, 96) and switching distribution routes for the process subject air in the casing (10). The casing (10) has a flat rectangular shape and has first and second inlet openings (13, 15) and first and second outlet openings (14, 16). A suction-side wall (12), which is one of side walls of the casing (10), has first and second inlet openings (13, 15) which are provided side by side in a longitudinal direction of the suction-side wall (12). The casing (10) contains an air filter (71, 76, 77) along the suction-side wall (12) for filtering process subject air introduced through the inlet openings (13, 15).

The third invention is based on the first invention, wherein the filter room (44) contains an air filter (71) for filtering the process subject air introduced through the inlet openings (13, 15), and the air filter (71) has a partitioning member (72) for partitioning the filter room (44) into a first portion (45) which is in communication with the first inlet opening (13) and a second portion (47) which is in communication with the second inlet opening (15).

The fourth invention is based on the second invention, wherein the air filter (71) includes a first filter portion (73) for filtering process subject air introduced through the first inlet opening (13), a second filter portion (74) for filtering process subject air introduced through the second inlet opening (15), and a partitioning member (72) for preventing air passing through the first filter portion (73) and air passing through the second filter portion (74) from mixing with each other, the first filter portion (73), the second filter portion (74), and the partitioning member (72) being integrally formed.

The fifth invention is based on the third or fourth invention, wherein at least one of side walls of the casing (10) which are adjacent to the suction-side wall (12) has a filter inspection lid (131) for allowing the air filter (71) to be removed out of the casing (10).

The sixth invention is based on the fifth invention, wherein the air filter (71) is attached onto an inner surface of the filter inspection lid (131).

The seventh invention is based on the third or fourth invention, wherein the air filter (71) is detachable from the casing (10) by being slid in a direction parallel to the suction-side wall (12).

The eighth invention is based on the first invention, wherein: the filter room (44) is partitioned into a first portion (45) which is in communication with the first inlet opening (13) and a second portion (47) which is in communication with the second inlet opening (15); and the first portion (45) contains a first air filter (76), and the second portion (47) contains a second air filter (77).

The ninth invention is based on the second invention, wherein the casing (10) contains a first air filter (76) for filtering process subject air introduced through the first inlet opening (13) and a second air filter (77) for filtering process subject air introduced through the second inlet opening (15).

The tenth invention is based on the eighth or ninth invention, wherein the casing (10) has a pair of side walls which face each other and are adjacent to the suction-side wall (12), each of the pair of side walls having a filter inspection lid (136, 137) which allows the air filter (76, 77) to be removed out of the casing (10).

The eleventh invention is based on the eighth or ninth invention, wherein the casing (10) has side walls adjacent to the suction-side wall (12), the side walls including a pair of side walls which face each other, one of the pair of side walls having a first filter inspection lid (136) which allows the first air filter (76) to be removed out of the casing (10), and the other of the pair of side walls having a second filter inspection lid (137) which allows the second air filter (77) to be removed out of the casing (10).

The twelfth invention is based on the eleventh invention, wherein the first air filter (76) is attached onto an inner surface of the first filter inspection lid (136), and the second air filter (77) is attached onto an inner surface of the second filter inspection lid (137).

The thirteenth invention is based on the eighth or ninth invention, wherein each of the air filters (76, 77) is detachable from the casing (10) by being slid in a direction parallel to the suction-side wall (12).

Functions

In the first and second inventions, process subject air is introduced into the casing (10) through the first and second inlet openings (13, 15) provided in the suction-side wall (12) by the operation of the first and second fans (95, 96). The process subject air, from which a foreign material has been removed by the air filter (71, 76, 77), is distributed in the casing (10). The humidity controller apparatuses of these inventions removes moisture from or adds moisture to the process subject air which is to be supplied to an indoor space alternately using the first adsorption element (81) and the second adsorption element (82) by switching distribution routes for the process subject air in the casing (10).

In the first invention, process subject air introduced through the inlet openings (13, 15) into the casing (10) is filtered by the air filter (71, 76, 77) contained in the filter room (44). In the second invention, process subject air introduced through the inlet openings (13, 15) into the casing (10) is filtered by the air filter (71, 76, 77) provided along the suction-side wall (12).

In the third invention, the filter room (44) is divided by the partitioning member (72) into the first portion (45) which is in communication with the first inlet opening (13) and the second portion (47) which is in communication with the second inlet opening (15). Process subject air introduced through the first inlet opening (13) flows into the first portion (45) of the filter room (44) and is filtered by the air filter (71). Process subject air introduced through the second inlet opening (15) flows into the second portion (47) of the filter room (44) and is filtered by the air filter (71).

In the fourth invention, in the air filter (71), the first filter portion (73), the second filter portion (74), and the partitioning member (72) are integrally formed. The first filter portion (73) filters the process subject air introduced through the first inlet opening (13). The second filter portion (74) filters the process subject air introduced through the second inlet opening (15). The partitioning member (72) constitutes a partition between an air path which is in communication with the first inlet opening (13) and an air path which is in communication with the second inlet opening (15) to prevent the process subject air introduced through the first inlet opening (13) and the process subject air introduced through the second inlet opening (15) from mixing with each other.

In the fifth invention, a side wall of the casing (10) which is adjacent to the suction-side wall (12) has the filter inspection lid (131). The air filter (71) is removed out of the casing (10) by opening the filter inspection lid (131).

In the sixth invention, the air filter (71) is attached onto an inner surface of the filter inspection lid (131). When the filter inspection lid (131) is detached from the casing (10), the air filter (71) moves along with the movement of the filter inspection lid (131), whereby the air filter (71) is removed out of the casing (10) together with the filter inspection lid (131).

In the seventh invention, the air filter (71) is detached from or attached to the casing (10) by being slid along the suction-side wall (12).

In the eighth invention, the process subject air introduced through the first inlet opening (13) flows into the first portion (45) of the filter room (44) and is filtered by the first air filter (76). Meanwhile, the process subject air introduced through the second inlet opening (15) flows into the second portion (47) of the filter room (44) and is filtered by the second air filter (77).

In the ninth invention, in the casing (10), the first air filter (76) and the second air filter (77) extend along the suction-side wall (12). The first air filter (76) filters the process subject air introduced through the first inlet opening (13). The second air filter (77) filters the process subject air introduced through the second inlet opening (15).

In the tenth invention, in the casing (10), among side walls adjacent to the suction-side wall (12), a pair of side walls, which face each other, have the filter inspection lids (136, 137), respectively. The air filters (76, 77) are removed out of the casing (10) by opening the filter inspection lids (136, 137).

In the eleventh invention, among side walls adjacent to the suction-side wall (12), a pair of side walls, which face each other, have the filter inspection lids (136, 137), respectively. One of the pair of side walls has the first filter inspection lid (136), and the other of the pair of side walls has the second filter inspection lid (137). When the first filter inspection lid (136) is opened, the first air filter (76) is removed out of the casing (10). When the second filter inspection lid (137) is opened, the second air filter (77) is removed out of the casing (10).

In the twelfth invention, the first air filter (76) is attached onto an inner surface of the first filter inspection lid (136), and the second air filter (77) is attached onto an inner surface of the second filter inspection lid (137). When the first filter inspection lid (136) is detached from the casing (10), the first air filter (76) moves along with the movement of the first filter inspection lid (136), whereby the first air filter (76) is removed out of the casing (10) together with the first filter inspection lid (136). When the second filter inspection lid (137) is detached from the casing (10), the second air filter (77) moves along with the movement of the second filter inspection lid (137), whereby the second air filter (77) is removed out of the casing (10) together with the second filter inspection lid (137).

In the thirteenth invention, each of the first and second air filters (76, 77) is attached to or detached from the casing (10) by being slid along the suction-side wall (12).

Effects

In the humidity controller apparatus of the first invention, the first and second inlet openings (13, 15) are formed side by side in the suction-side wall (12) of the casing (10), and the air filter (71, 76, 77) is placed in the filter room (44) which is in communication with the first and second inlet openings (13, 15). In the humidity controller apparatus of the second invention, the first and second inlet openings (13, 15) are formed side by side in the suction-side wall (12) of the casing (10), and the air filter (71, 76, 77) is placed along the suction-side wall (12) which has the first and second inlet openings (13, 15) formed therein.

Thus, according to the present invention, the air filter (71, 76, 77) for filtering the process subject air introduced through the first and second inlet openings (13, 15) can be intensively provided at one place in the casing (10). Therefore, the number of steps for the tasks of pulling the air filter (71, 76, 77) out of the casing (10) and pushing the air filter (71, 76, 77) back into the casing (10) can be reduced. Thus, according to this embodiment, the workability of the maintenance tasks for the air filter (71, 76, 77) is improved, while the process subject air is filtered by the air filter (71, 76, 77) provided immediately next to the inlet openings (13, 15), whereby the amount of dusts, and the like, introduced into the casing (10) is reduced.

In the third and fourth inventions, both the process subject air flowing from the first inlet opening (13) into the casing (10) and the process subject air flowing from the second inlet opening (15) into the casing (10) are filtered by one air filter (71). Thus, in a maintenance process of the air filter (71), only one piece of this air filter is detached from and attached to the casing (10). Therefore, the workability of the maintenance tasks for the air filter (71) is further improved. In these inventions, the air filter (71) is provided with the partition (72). The streams of process subject air introduced through the inlet openings (13, 15) into the casing (10) are filtered by one air filter (71) while being prevented from mixing with each other.

In the fifth invention, at least one of side walls adjacent to the suction-side wall (12) of the casing (10) has the filter inspection lid (131) which allows the air filter (71) to be taken out. Thus, the air filter (71) can be taken out only by opening the filter inspection lid (131). Therefore, the workability of the maintenance tasks for the air filter (71) is further improved. In the case where the filter inspection lid (131) is provided to each of the side walls adjacent to the suction-side wall (12) of the casing (10), the air filter (71) can be taken out through any of the side walls.

In the sixth and twelfth inventions, the air filters (71, 76, 77) are fixed onto the inner surface of the filter inspection lids (131, 136, 137). Thus, when the filter inspection lids (131, 136, 137) are detached from the casing (10), the air filters (71, 76, 77) are also detached from the casing (10) by the operation of detaching the lids. Therefore, the number of steps of the maintenance tasks for the air filters (71, 76, 77) can be reduced.

In the seventh and thirteenth inventions, the air filters (71, 76, 77) are detached from the casing (10) by a relatively simple operation of sliding the air filters (71, 76, 77). Therefore, the maintenance tasks for the air filters (71, 76, 77) can be further simplified. In these inventions, the air filters (71, 76, 77) are slid in directions parallel to the suction-side wall (12). Thus, the air filters (71, 76, 77) can be detached from the casing (10) without a relatively complicated task of detaching the suction-side wall (12) which has the inlet openings (13, 15) from the casing (10). Therefore, also as to this point, the maintenance tasks for the air filters (71, 76, 77) can be simplified.

In the eighth invention, the air filters (76, 77) are provided in the first portion (45) of the filter room (44) which is in communication with the first inlet opening (13) and the second portion (47) of the filter room (44) which is in communication with the second inlet opening (15), respectively. Thus, the streams of process subject air introduced through the inlet openings (13, 15) are filtered by the air filters (76, 77) provided in the portions (45, 47) of the filter room (44) while being prevented from mixing with each other. Further, the air filters (76, 77) contained in the first portion (45) and the second portion (47) may be of different types.

In the ninth invention, the casing (10) contains the first air filter (76) and the second air filter (77). Thus, the process subject air introduced through the inlet openings (13, 15) can be surely purified. The characteristics of the first air filter (76) and the second air filter (77), such as the collection efficiency, and the like, may be different.

In the tenth invention, a pair of side walls of the casing (10) which are adjacent to the suction-side wall (12) and face each other have the filter inspection lids (136, 137) for allowing the air filters (76, 77) to be removed out of the casing (10). Thus, the air filters (76, 77) provided in the first portion (45) and the second portion (47) of the filter room (44) can be taken out by opening the filter inspection lids (136, 137), respectively.

In the eleventh invention, among the side walls of the casing (10), a pair of side walls which face each other have the filter inspection lids (136, 137), respectively. By opening the first filter inspection lid (136), the first air filter (76) is removed out of the casing (10). By opening the second filter inspection lid (137), the second air filter (77) is removed out of the casing (10). Therefore, the number of steps of the maintenance tasks for the air filter (71) can be reduced.

BEST MODE FOR CARRYING OUT THE INVENTION

Hereinafter, embodiments of the present invention will be described in detail with reference to the drawings. It should be noted that the embodiments described in the following sections are merely examples which are essentially preferred and are not intended to limit the present invention or the extent of applications and uses thereof.

Embodiment 1

A humidity controller apparatus according to embodiment 1 switchably performs a dehumidification operation for supplying moisture-reduced air into a room and a humidification operation for supplying moisture-added air into the room. For example, the humidity controller apparatus is installed in the ceiling of the room. This humidity controller apparatus includes a refrigerant circuit and two adsorption elements (81, 82) to perform a so-called batch-type operation.

Herein, the structure of the humidity controller apparatus of this embodiment is described with reference to FIG. 1 to FIG. 9. In the descriptions of this embodiment, "top", "bottom", "left", "right", "front", "rear", "near", and "far" are defined with respect to the front face side of the humidity controller apparatus shown in FIG. 1 (bottom side of FIG. 1) unless otherwise noted.

Figure 1:
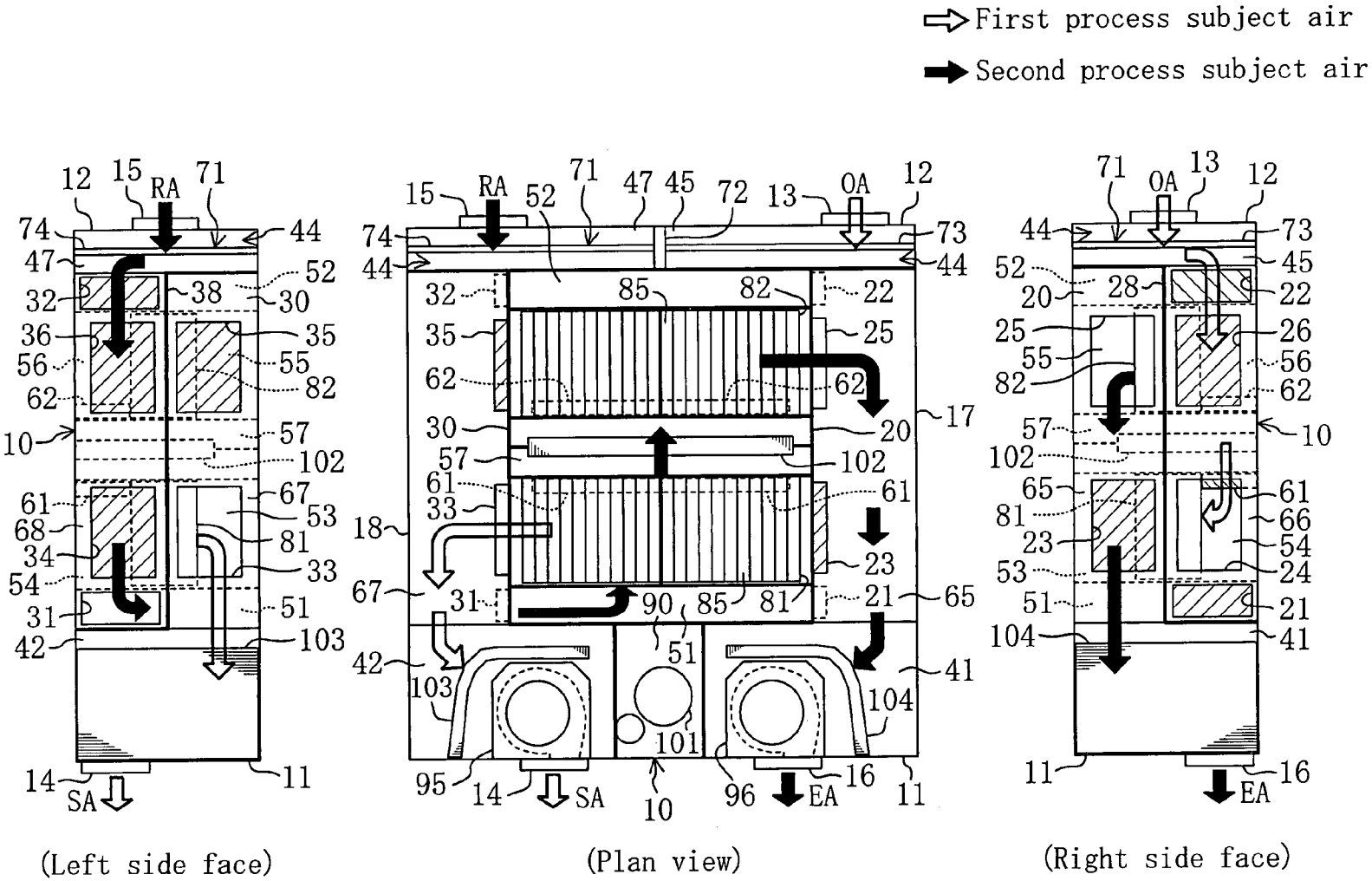
FIG. 1 shows a general structure of a humidity controller apparatus according to embodiment 1 and streams of air in a first operation of dehumidification operation.

As shown in FIG. 1, the above-described humidity controller apparatus includes a slightly-flat rectangular casing (10). This casing (10) contains two adsorption elements (81, 82) and a refrigerant circuit.

In the refrigerant circuit, a regeneration heat exchanger (102) functioning as a heater, a first heat exchanger (103), a second heat exchanger (104), a compressor (101), and an expansion valve are connected through pipes. It should be noted that illustration of the expansion valve and the pipes is omitted. In this refrigerant circuit, a refrigeration cycle is performed by the circulation of a charged refrigerant. The refrigerant circuit switchably performs an operation with the first heat exchanger (103) functioning as an evaporator and an operation with the second heat exchanger (104) functioning as an evaporator.

Figure 6:
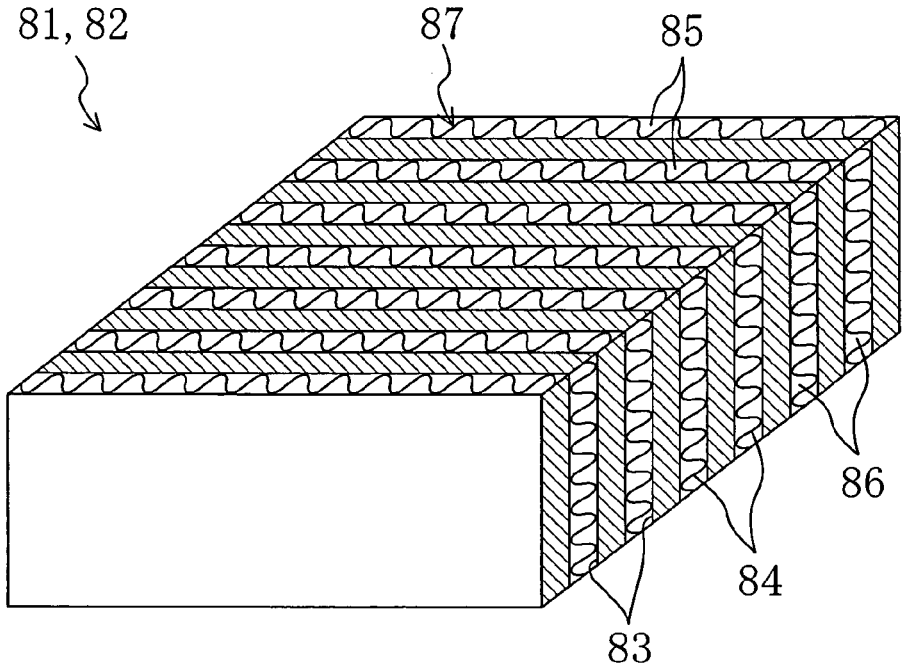
FIG. 6 is a general perspective view showing a structure of an adsorption element of the humidity controller apparatus according to embodiment 1.

As shown in FIG. 6, the adsorption elements (81, 82) are each formed by flat plate members (83) and corrugated wavy plate members (84) which are alternately superposed. The wavy plate members (84) are superposed such that the ridge lines of adjacent wavy plate members (84) are shifted by 90° from each other. The adsorption elements (81, 82) each has a rectangular shape or the shape of a quadrangular prism.

In the adsorption elements (81, 82), humidity control side paths (85) and cooling side paths (86) are formed alternately with the flat plate members (83) inserted therebetween in the direction of superposition of the flat plate members (83) and the wavy plate members (84). In each of the adsorption elements (81, 82), the humidity control side paths (85) have openings on side faces of the adsorption element on which the longer edges of the flat plate members (83) are seen, while the cooling side paths (86) have openings on other side faces of the adsorption element on which the shorter edges of the flat plate members (83) are seen.

In the adsorption elements (81, 82), the surfaces of the flat plate members (83) and the wavy plate members (84) which define the humidity control side paths (85) are coated with an adsorbent material for adsorbing water vapor. Examples of the adsorbent material include silica gel, zeolite, ion-exchange resins, etc.

As shown in FIG. 1, each of the adsorption elements (81, 82) is separated into two parts at the longitudinal center. At the time of maintenance, only one of the two parts can be removed out of the apparatus. It should be noted that the adsorption elements (81, 82) may not be separated.

The casing (10) has a first panel (11) at the nearest side and a second panel (12) at the farthest side. The casing (10) further has a third panel (17) at the right side and a fourth panel (18) at the left side, which are perpendicular to the first panel (11). The first panel (11) has a first outlet opening (14) at lower left part and a second outlet opening (16) at lower right part. The second panel (12) has a second inlet opening (15) at the left side and a first inlet opening (13) at the right side, which are provided side by side in a longitudinal direction of the second panel (12). The second panel (12) constitutes a suction-side wall.

Figure 9:
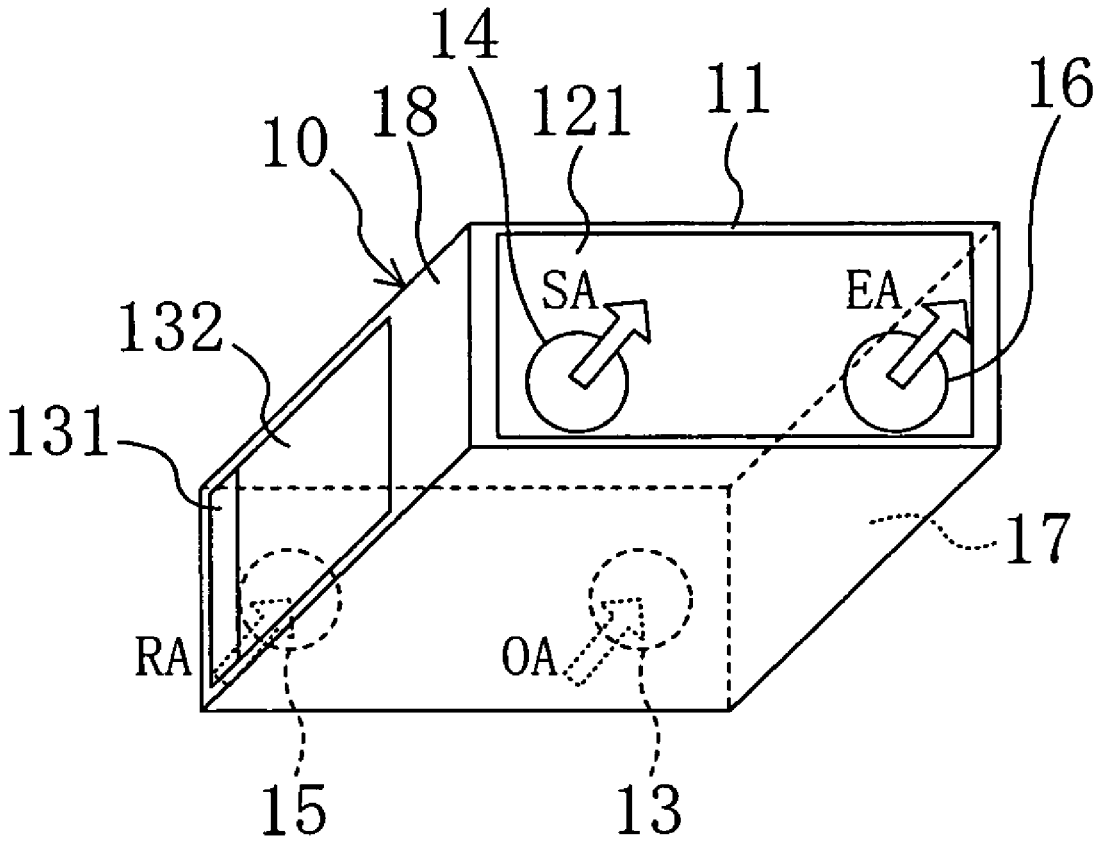
FIG. 9 is a general perspective view showing the positions of inspection hole lids of the humidity controller apparatus of embodiment 1.

As shown in FIG. 9, the fourth panel (18) has a filter inspection lid (131) and an element inspection lid (132). Each of the filter inspection lid (131) and the element inspection lid (132) is partially removed from the casing (10). The first panel (11) has a fan inspection lid (121). The fan inspection lid (121) and the element inspection lid (132) each may be formed by two or more divisional parts.

Figure 7:
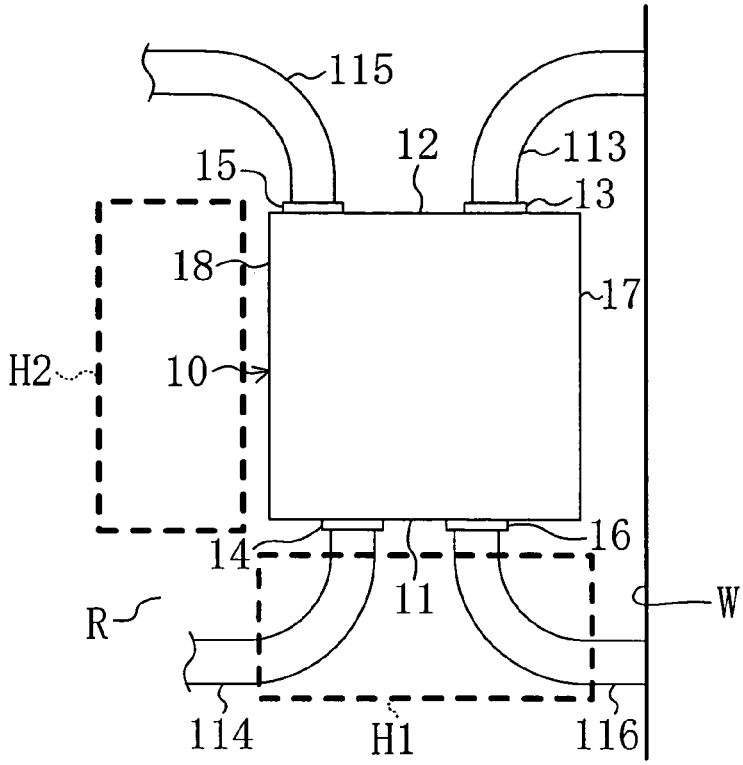
FIG. 7 is a general plan view illustrating installation of the humidity controller apparatus according to embodiment 1.
Figure 8:
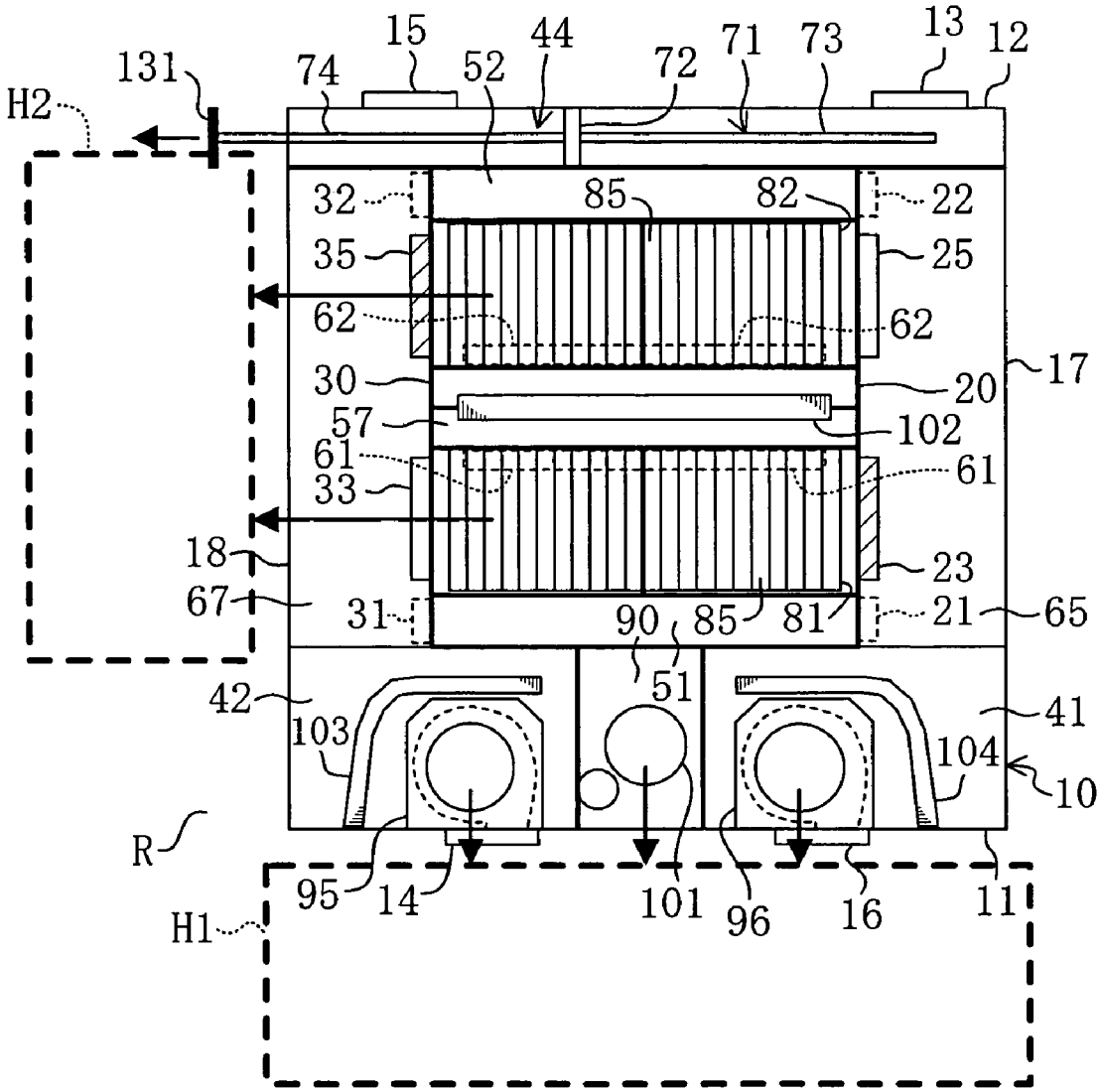
FIG. 8 is a general plan view illustrating by arrows the direction in which a device is pulled out at the time of maintenance in the humidity controller apparatus of embodiment 1.

As shown in FIG. 7 and FIG. 8, the ceiling (R) has a first inspection manhole (H1), which is to be opened/closed by a maintenance person at the time of maintenance, in the vicinity of the first panel (11) of the casing (10). The ceiling (R) also has a second inspection manhole (H2), which is to be opened/closed by a maintenance person at the time of maintenance, in the vicinity of the fourth panel (18) of the casing (10).

As shown in FIG. 1, the inside of the casing (10) is three partitioned spaces which subsequently occur in a direction extending from the first panel (11) at the nearest side to the second panel (12) at the farthest side.

The space formed near the first panel (11) of the casing (10) is further partitioned into three spaces provided side by side. One of the three spaces at the right side constitutes a second outlet flow path (41), and the space at the left side constitutes a first outlet flow path (42). The space sandwiched between the second outlet flow path (41) and the first outlet flow path (42) constitutes an accommodation space (90). The accommodation space (90) is a close space in which the compressor (101) of the refrigerant circuit is installed.

The second outlet flow path (41) is in communication with the second outlet opening (16). In the second outlet flow path (41), a second outlet fan (96) (second fan) and the second heat exchanger (104) are installed. The second outlet fan (96) is attached onto the internal surface of the fan inspection lid (121) of the first panel (11) such that the outlet side of the second outlet fan (96) is connected to the second outlet opening (16). The second heat exchanger (104) carries out an exchange of heat between a stream of air toward the second outlet fan (96) and a refrigerant of the refrigerant circuit.

The first outlet flow path (42) is in communication with the first outlet opening (14). In the first outlet flow path (42), a first outlet fan (95) (first fan) and the first heat exchanger (103) are installed. The first outlet fan (95) is attached onto the internal surface of the fan inspection lid (121) of the first panel (11) such that the outlet side of the first outlet fan (95) is connected to the first outlet opening (14). The first heat exchanger (103) carries out an exchange of heat between a stream of air toward the first outlet fan (95) and a refrigerant of the refrigerant circuit.

Inside the casing (10), a room (44) for a filter, which is in communication with the first and second inlet openings (13, 15), is provided along the second panel (12). In the filter room (44), an air filter (71) is provided along the second panel (12). The left end of the air filter (71) is attached onto the internal surface of the filter inspection lid (131). The air filter (71) has substantially the same size as that of the second panel (12). For example, the air filter (71) is placed to cover the entirety of the filter room (44) when viewed from the position of the second panel (12).

The air filter (71) is provided with a partition (72) at the center of its width (along the direction extending between the left and right sides in FIG. 1). The partition (72) is formed of, for example, foamed polyethylene, foamed urethane, or the like. A half of the air filter (71) at the right side of the partition (72) constitutes a first filter portion (73), and the other half at the left side of the partition (72) constitutes a second filter portion (74). The air filter (71) is detachable from the casing (10) by being slid left and right along the second panel (12).

With the air filter (71) being installed in the filter room (44), the filter room (44) is partitioned by the partition (72) into left and right parts. A half of the filter room (44) at the right side of the partition (72) constitutes a suction side right flow path (45) (first portion). The suction side right flow path (45) is in communication with the first inlet opening (13). The suction side right flow path (45) is provided with the first filter portion (73). The other half of the filter room (44) at the left side of the partition (72) constitutes a suction side left flow path (47) (second portion). The suction side left flow path (47) is in communication with the second inlet opening (15). The suction side left flow path (47) is provided with the second filter portion (74).

The space provided in the center of the depth of the casing (10) includes three spaces partitioned by a right partition (20) and a left partition (30) such that the partitioned spaces are provided side by side along the width of the casing (10).

The space at the right side of the right partition (20) is partitioned by a right horizontal partition (28) into upper and lower parts. The upper part of this space constitutes a right upper flow path (65), and the lower part constitutes a right lower flow path (66). The right upper flow path (65) is in communication with the second outlet flow path (41) but separated from the suction side right flow path (45). The right lower flow path (66) is in communication with the suction side right flow path (45) but separated from the second outlet flow path (41).

The space at the left side of the left partition (30) is partitioned by a left horizontal partition (38) into upper and lower parts. The upper part of this space constitutes a left upper flow path (67), and the lower part constitutes a left lower flow path (68). The left upper flow path (67) is in communication with the first outlet flow path (42) but separated from the suction side left flow path (47). The left lower flow path (68) is in communication with the suction side left flow path (47) but separated from the first outlet flow path (42).

Figure 5A:
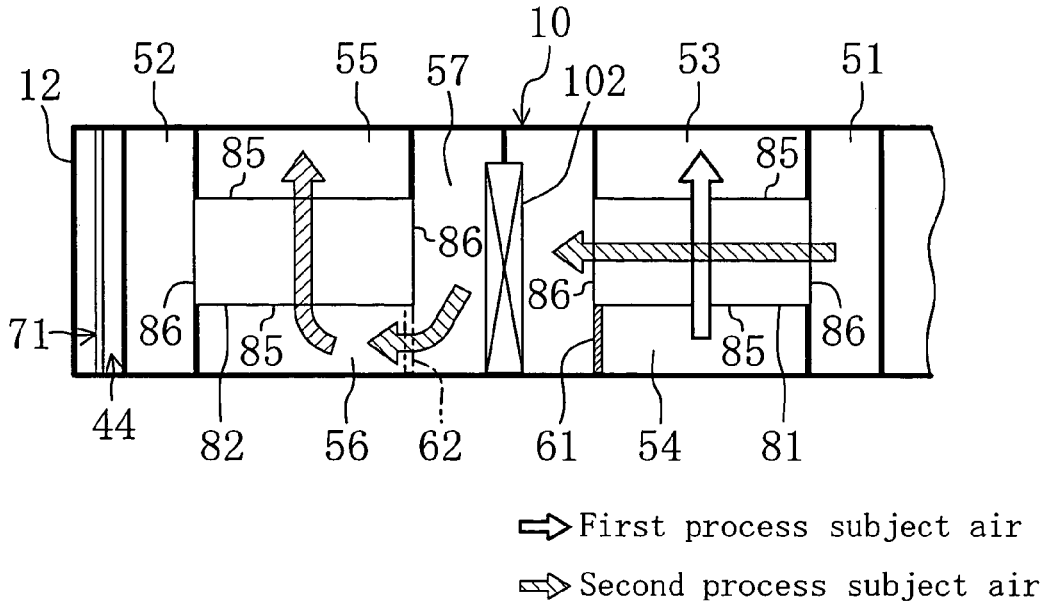
FIG. 5A is an enlarged view of principal part of the humidity controller apparatus of embodiment 1, which illustrates streams of air in the first operation.
Figure 5B:
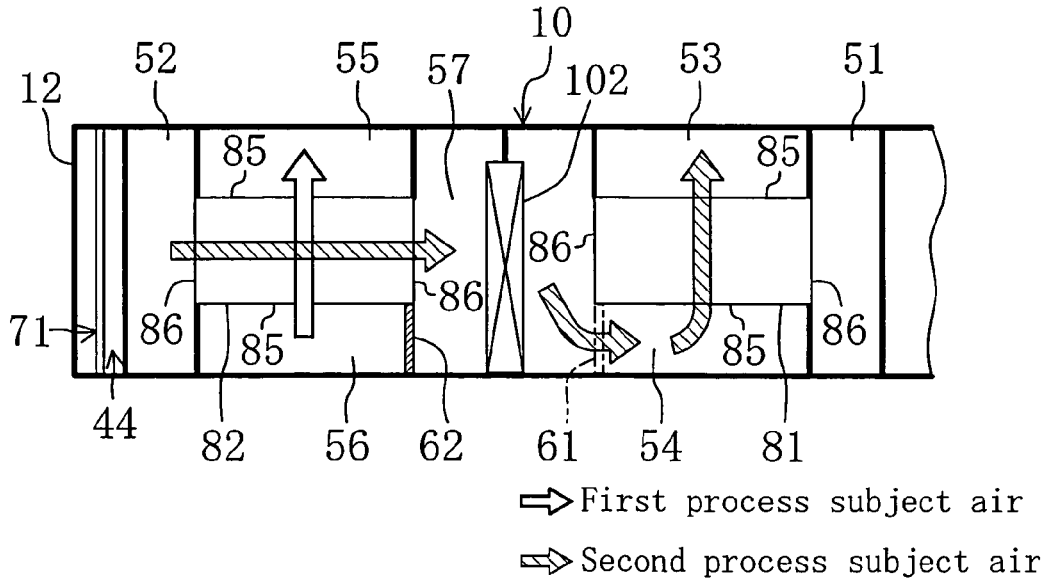
FIG. 5B is an enlarged view of principal part of the humidity controller apparatus of embodiment 1, which illustrates streams of air in the second operation.

As also shown in FIG. 5A and FIG. 5B, the two adsorption elements (81, 82) are provided between the right partition (20) and the left partition (30). The adsorption elements (81, 82) are placed in the casing (10) in parallel with each other with a predetermined interval therebetween such that the longitudinal directions of the elements extend along the longitudinal direction of the first panel (11). Specifically, the first adsorption element (81) is closer to the first panel (11), while the second adsorption element (82) is closer to the second panel (12).

The adsorption elements (81, 82) are each installed in a posture such that the direction of superposition of the flat plate members (83) and wavy plate members (84) is identical to the width direction of the casing (10). Each of the adsorption elements (81, 82) in this posture has the openings of the humidity control side paths (85) in its upper and lower faces and the openings of the cooling side paths (86) in its front and rear faces. However, none of the openings of the humidity control side paths (85) and the cooling side paths (86) appears in the left and right faces of the adsorption element.

As also shown in FIG. 5A and FIG. 5B, the space between the right partition (20) and the left partition (30) are partitioned into a first flow path (51), a second flow path (52), a first upper flow path (53), a first lower flow path (54), a second upper flow path (55), a second lower flow path (56), and a central flow path (57).

The first flow path (51) is formed at the front side of the first adsorption element (81) to be in communication with the cooling side paths (86) of the first adsorption element (81). The second flow path (52) is formed at the rear side of the second adsorption element (82) to be in communication with the cooling side paths (86) of the second adsorption element (82).

The first upper flow path (53) is formed at the upper side of the first adsorption element (81) to be in communication with the humidity control side paths (85) of the first adsorption element (81). The first lower flow path (54) is formed at the lower side of the first adsorption element (81) to be in communication with the humidity control side paths (85) of the first adsorption element (81). The second upper flow path (55) is formed at the upper side of the second adsorption element (82) to be in communication with the humidity control side paths (85) of the second adsorption element (82). The second lower flow path (56) is formed at the lower side of the second adsorption element (82) to be in communication with the humidity control side paths (85) of the second adsorption element (82).

The central flow path (57) is formed between the first adsorption element (81) and the second adsorption element (82) to be in communication with the cooling side paths (86) of both the adsorption elements (81, 82). In the central flow path (57), the regeneration heat exchanger (102) stands substantially upright. The regeneration heat exchanger (102) carries out an exchange of heat between a stream of air in the central flow path (57) and a refrigerant of the refrigerant circuit. The regeneration heat exchanger (102) functions as a condenser to constitute a heater for heating air. It should be noted that the regeneration heat exchanger (102) may lie substantially horizontally in the central flow path (57).

The partition between the central flow path (57) and the first lower flow path (54) is separated into two parts (left and right parts) by a separation surface at the longitudinal center of the first adsorption element (81). Each of the left and right parts of the partition is provided with a first shutter (61). The partition between the central flow path (57) and the second lower flow path (56) is also separated into two parts (left and right parts) by a separation surface at the longitudinal center of the second adsorption element (82). Each of the left and right parts of the partition is provided with a second shutter (62). Each of the first shutter (61) and the second shutter (62) is provided as an openable/closable damper integrally with the adsorption element (81, 82) and is removable at the time of maintenance together with the adsorption element (81, 82). It should be noted that the first shutter (61) and the second shutter (62) may be provided separately from the adsorption elements (81, 82).

The right partition (20) has three divisional parts from the front side to the rear side. Among the three divisional parts of the right partition (20), the frontmost part has a first right side opening (21), a first right upper opening (23), and a first right lower opening (24). The rearmost part of the right partition (20) has a second right side opening (22), a second right upper opening (25), and a second right lower opening (26). A shutter which functions as a damper is openably/closably provided to each of the openings (21, 22, . . . ). The shutter is integrally formed with the adsorption element (81, 82). At the time of maintenance, the shutter is removable together with the divisional part of the right partition (20) and the adsorption element (81, 82).

The first right side opening (21) is provided in the front lower part of the right partition (20). With the shutter of the first right side opening (21) being open, the first flow path (51) and the right lower flow path (66) are in communication with each other. The second right side opening (22) is provided in the rear lower part of the right partition (20). With the shutter of the second right side opening (22) being open, the second flow path (52) and the right lower flow path (66) are in communication with each other.

The first right upper opening (23) is provided in upper part of a portion of the right partition (20) which is adjacent to the first adsorption element (81). With the shutter of the first right upper opening (23) being open, the first upper flow path (53) and the right upper flow path (65) are in communication with each other. The first right lower opening (24) is provided in lower part of a portion of the right partition (20) which is adjacent to the first adsorption element (81). With the shutter of the first right lower opening (24) being open, the first lower flow path (54) and the right lower flow path (66) are in communication with each other.

The second right upper opening (25) is provided in upper part of a portion of the right partition (20) which is adjacent to the second adsorption element (82). With the shutter of the second right upper opening (25) being open, the second upper flow path (55) and the right upper flow path (65) are in communication with each other. The second right lower opening (26) is provided in lower part of a portion of the right partition (20) which is adjacent to the second adsorption element (82). With the shutter of the second right lower opening (26) being open, the second lower flow path (56) and the right lower flow path (66) are in communication with each other.

The left partition (30) also has three divisional parts from the front side to the rear side. Among the three divisional parts of the left partition (30), the frontmost part has a first left side opening (31), a first left upper opening (33), and a first left lower opening (34). The rearmost part of the left partition (30) has a second left side opening (32), a second left upper opening (35), and a second left lower opening (36). A shutter which functions as a damper is openably/closably provided to each of the openings (31, 32, . . . ). The shutter is integrally formed with the adsorption element (81, 82). At the time of maintenance, the shutter is removable together with the divisional part of the left partition (30) and the adsorption element (81, 82).

The first left side opening (31) is provided in the front lower part of the left partition (30). With the shutter of the first left side opening (31) being open, the first flow path (51) and the left lower flow path (68) are in communication with each other. The second left side opening (32) is provided in the rear lower part of the left partition (30). With the shutter of the second left side opening (32) being open, the second flow path (52) and the left lower flow path (68) are in communication with each other.

The first left upper opening (33) is provided in upper part of a portion of the left partition (30) which is adjacent to the first adsorption element (81). With the shutter of the first left upper opening (33) being open, the first upper flow path (53) and the left upper flow path (67) are in communication with each other. The first left lower opening (34) is provided in lower part of a portion of the left partition (30) which is adjacent to the first adsorption element (81). With the shutter of the first left lower opening (34) being open, the first lower flow path (54) and the left lower flow path (68) are in communication with each other.

The second left upper opening (35) is provided in upper part of a portion of the left partition (30) which is adjacent to the second adsorption element (82). With the shutter of the second left upper opening (35) being open, the second upper flow path (55) and the left upper flow path (67) are in communication with each other. The second left lower opening (36) is provided in lower part of a portion of the left partition (30) which is adjacent to the second adsorption element (82). With the shutter of the second left lower opening (36) being open, the second lower flow path (56) and the left lower flow path (68) are in communication with each other.

As shown in FIG. 7, the humidity controller apparatus is installed such that the first inlet opening (13) and the second outlet opening (16) are in communication with the outdoor space, while the second inlet opening (15) and the first outlet opening (14) are in communication with the indoor space.

Specifically, in this humidity controller apparatus, the third panel (17) which is closer to the first inlet opening (13) and the second outlet opening (16) is in the vicinity of a wall (W) on the outdoor side, while the fourth panel (18) which is closer to the second inlet opening (15) and the first outlet opening (14) is on the indoor side. On the first panel (11), an indoor side outlet duct (114) is connected to the first outlet opening (14), and an outdoor side outlet duct (116) is connected to the second outlet opening (16). On the second panel (12), an outdoor side inlet duct (113) is connected to the first inlet opening (13), and an indoor side inlet duct (115) is connected to the second inlet opening (15). These ducts (113, 114, . . . ) are each preferably formed by a flexible bellows rather than a sheet metal such that the ducts are removable at the time of inspection.

Operations

The above-described humidity controller apparatus operates while switching between a dehumidification operation and a humidification operation. During the dehumidification operation and the humidification operation, the humidity controller apparatus alternately performs a first operation and a second operation.

<Dehumidification Operation>

Figure 2:
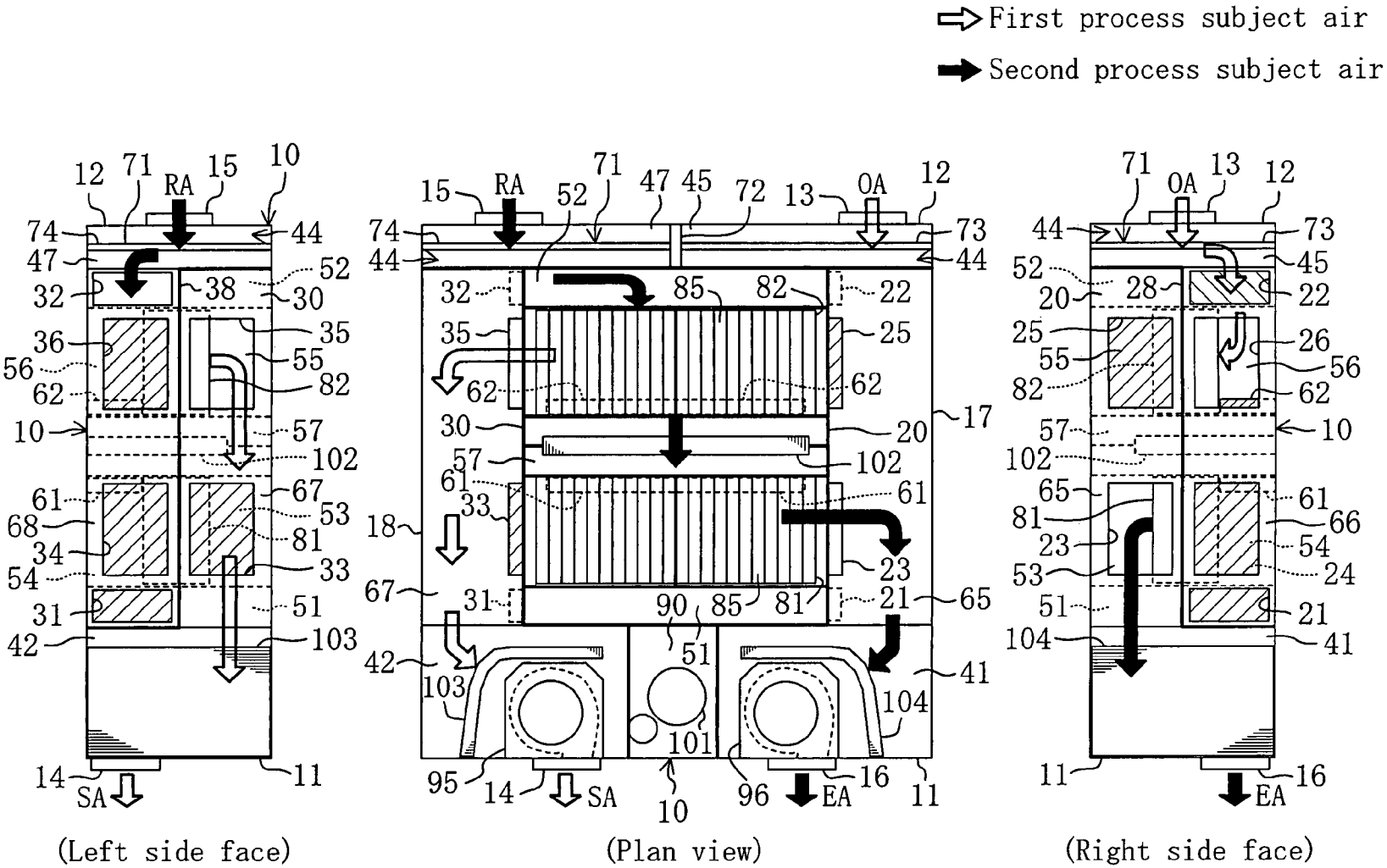
FIG. 2 shows the general structure of the humidity controller apparatus according to embodiment 1 and streams of air in a second operation of dehumidification operation.

As shown in FIG. 1 and FIG. 2, in the dehumidification operation, when the first outlet fan (95) is driven, outdoor air (OA) is introduced the casing (10) through the first inlet opening (13). The outdoor air flows as first process subject air into the suction side right flow path (45). The first process subject air is filtered by the first filter portion (73) of the air filter (71). When the second outlet fan (96) is driven, indoor air (RA) is introduced into the casing (10) through the second inlet opening (15). The indoor air flows as second process subject air into the suction side left flow path (47). The second process subject air is filtered by the second filter portion (74) of the air filter (71).

Since the filter room (44) is separated by the partition (72) of the air filter (71) into two parts, the outdoor air introduced through the first inlet opening (13) and the indoor air introduced through the second inlet opening (15) do not mix with each other.

In the dehumidification operation, in the refrigerant circuit, the regeneration heat exchanger (102) functions as a condenser, and the first heat exchanger (103) functions as an evaporator, while the second heat exchanger (104) is at rest.

The first operation of the dehumidification operation is described with reference to FIG. 1, FIG. 5A, and FIG. 5B. In the first operation, an adsorption process with the first adsorption element (81) and a regeneration process with the second adsorption element (82) are performed. That is, in the first operation, the moisture of air is reduced by the first adsorption element (81) while the adsorbent material of the second adsorption element (82) is regenerated.

As shown in FIG. 1, in the right partition (20), the first right lower opening (24) and the second right upper opening (25) allow communication therethrough, while the other openings (21, 22, 23, 26) are closed. In the left partition (30), the first left side opening (31) and the first left upper opening (33) allow communication therethrough, while the other openings (32, 34, 35, 36) are closed. The first shutter (61) is closed, while the second shutter (62) is open.

The first process subject air flows from the suction side right flow path (45) to the right lower flow path (66). Thereafter, the first process subject air passes through the first right lower opening (24) to flow into the first lower flow path (54). Meanwhile, the second process subject air flows from the suction side left flow path (47) to the left lower flow path (68). Thereafter, the second process subject air passes through the first left side opening (31) to flow into the first flow path (51).

As also shown in FIG. 5A, the first process subject air of the first lower flow path (54) flows into the humidity control side paths (85) of the first adsorption element (81). While the first process subject air passes through the humidity control side paths (85), the water vapor contained in the first process subject air is adsorbed by the adsorbent material. The first process subject air whose moisture has been reduced by the first adsorption element (81) then flows into the first upper flow path (53).

Meanwhile, the second process subject air of the first flow path (51) flows into the cooling side paths (86) of the first adsorption element (81). While passing through the cooling side paths (86), the second process subject air absorbs adsorption heat which has been produced through adsorption of the water vapor by the adsorbent material in the humidity control side paths (85). After having absorbed the adsorption heat, the second process subject air flows into the central flow path (57) and passes through the regeneration heat exchanger (102). In the regeneration heat exchanger (102), the second process subject air is heated through a heat exchange with the refrigerant. Thereafter, the second process subject air flows from the central flow path (57) into the second lower flow path (56).

The second process subject air heated by the first adsorption element (81) and the regeneration heat exchanger (102) is introduced to the humidity control side paths (85) of the second adsorption element (82). In the humidity control side paths (85), the adsorbent material is heated by the second process subject air so that water vapor is desorbed from the adsorbent material. That is, the second adsorption element (82) is regenerated. The water vapor desorbed from the absorbent material flows into the second upper flow path (55) together with the second process subject air.

As shown in FIG. 1, the moisture-reduced first process subject air flowing into the first upper flow path (53) then passes through the first left upper opening (33) to flow into the left upper flow path (67). Thereafter, the moisture-reduced first process subject air flows into the first outlet flow path (42). While flowing through the first outlet flow path (42), the first process subject air passes through the first heat exchanger (103). In the first heat exchanger (103), the first process subject air is cooled though a heat exchange with the refrigerant. Thereafter, the cooled, moisture-reduced first process subject air passes through the indoor side outlet duct (114) connected to the first outlet opening (14) to be supplied to the indoor space.

Meanwhile, the second process subject air flowing into the second upper flow path (55) then passes through the second right upper opening (25) to flow in the right upper flow path (65). Thereafter, the second process subject air flows into the second outlet flow path (41). While flowing through the second outlet flow path (41), the second process subject air passes through the second heat exchanger (104). Since the second heat exchanger (104) is at rest, the second process subject air is not heated or cooled. Then, the second process subject air, which has been used for cooling of the first adsorption element (81) and regeneration of the second adsorption element (82), is expelled to the outdoor space through the outdoor side outlet duct (116) connected to the second outlet opening (16).

The second operation of dehumidification operation is described with reference to FIG. 2, FIG. 5A, and FIG. 5B. In the second operation, contrary to the first operation, an adsorption process with the second adsorption element (82) and a regeneration process with the first adsorption element (81) are performed. That is, in the second operation, the moisture of air is reduced by the second adsorption element (82) while the adsorbent material of the first adsorption element (81) is regenerated.

As shown in FIG. 2, in the right partition (20), the first right upper opening (23) and the second right lower opening (26) allow communication therethrough, while the other openings (21, 22, 24, 25) are closed. In the left partition (30), the second left side opening (32) and the second left upper opening (35) allow communication therethrough, while the other openings (31, 33, 34, 36) are closed. The second shutter (62) is closed, while the first shutter (61) is open.

The first process subject air flows from the suction side right flow path (45) to the right lower flow path (66). Thereafter, the first process subject air passes through the second right lower opening (26) to flow into the second lower flow path (56). Meanwhile, the second process subject air flows from the suction side left flow path (47) to the left lower flow path (68). Thereafter, the second process subject air passes through the second left side opening (32) to flow into the second flow path (52).

As also shown in FIG. 5B, the first process subject air of the second lower flow path (56) then flows into the humidity control side paths (85) of the second adsorption element (82). While the first process subject air passes through the humidity control side paths (85), the water vapor contained in the first process subject air is adsorbed by the adsorbent material. The first process subject air whose moisture has been reduced by the second adsorption element (82) then flows into the second upper flow path (55).

Meanwhile, the second process subject air of the second flow path (52) then flows into the cooling side paths (86) of the second adsorption element (82). While passing through the cooling side paths (86), the second process subject air absorbs adsorption heat which has been produced through adsorption of the water vapor by the adsorbent material in the humidity control side paths (85). After having absorbed the adsorption heat, the second process subject air flows into the central flow path (57) and passes through the regeneration heat exchanger (102). In the regeneration heat exchanger (102), the second process subject air is heated through a heat exchange with the refrigerant. Thereafter, the second process subject air flows from the central flow path (57) into the first lower flow path (54).

The second process subject air heated by the second adsorption element (82) and the regeneration heat exchanger (102) is introduced to the humidity control side paths (85) of the first adsorption element (81). In the humidity control side paths (85), the adsorbent material is heated by the second process subject air so that water vapor is desorbed from the adsorbent material. That is, the first adsorption element (81) is regenerated. The water vapor desorbed from the absorbent material flows into the first upper flow path (53) together with the second process subject air.

As shown in FIG. 2, the moisture-reduced first process subject air flowing into the second upper flow path (55) then passes through the second left upper opening (35) to flow into the left upper flow path (67). Thereafter, the moisture-reduced first process subject air flows into the first outlet flow path (42). While flowing through the first outlet flow path (42), the first process subject air passes through the first heat exchanger (103). In the first heat exchanger (103), the first process subject air is cooled though a heat exchange with the refrigerant. Thereafter, the cooled, moisture-reduced first process subject air passes through the indoor side outlet duct (114) connected to the first outlet opening (14) to be supplied to the indoor space.

Meanwhile, the second process subject air flowing into the first upper flow path (53) then passes through the first right upper opening (23) to flow in the right upper flow path (65). Thereafter, the second process subject air flows into the second outlet flow path (41). While flowing through the second outlet flow path (41), the second process subject air passes through the second heat exchanger (104). Since the second heat exchanger (104) is at rest, the second process subject air is not heated or cooled. Then, the second process subject air, which has been used for cooling of the second adsorption element (82) and regeneration of the first adsorption element (81), is expelled to the outdoor space through the outdoor side outlet duct (116) connected to the second outlet opening (16).

<Humidification Operation>

Figure 3:
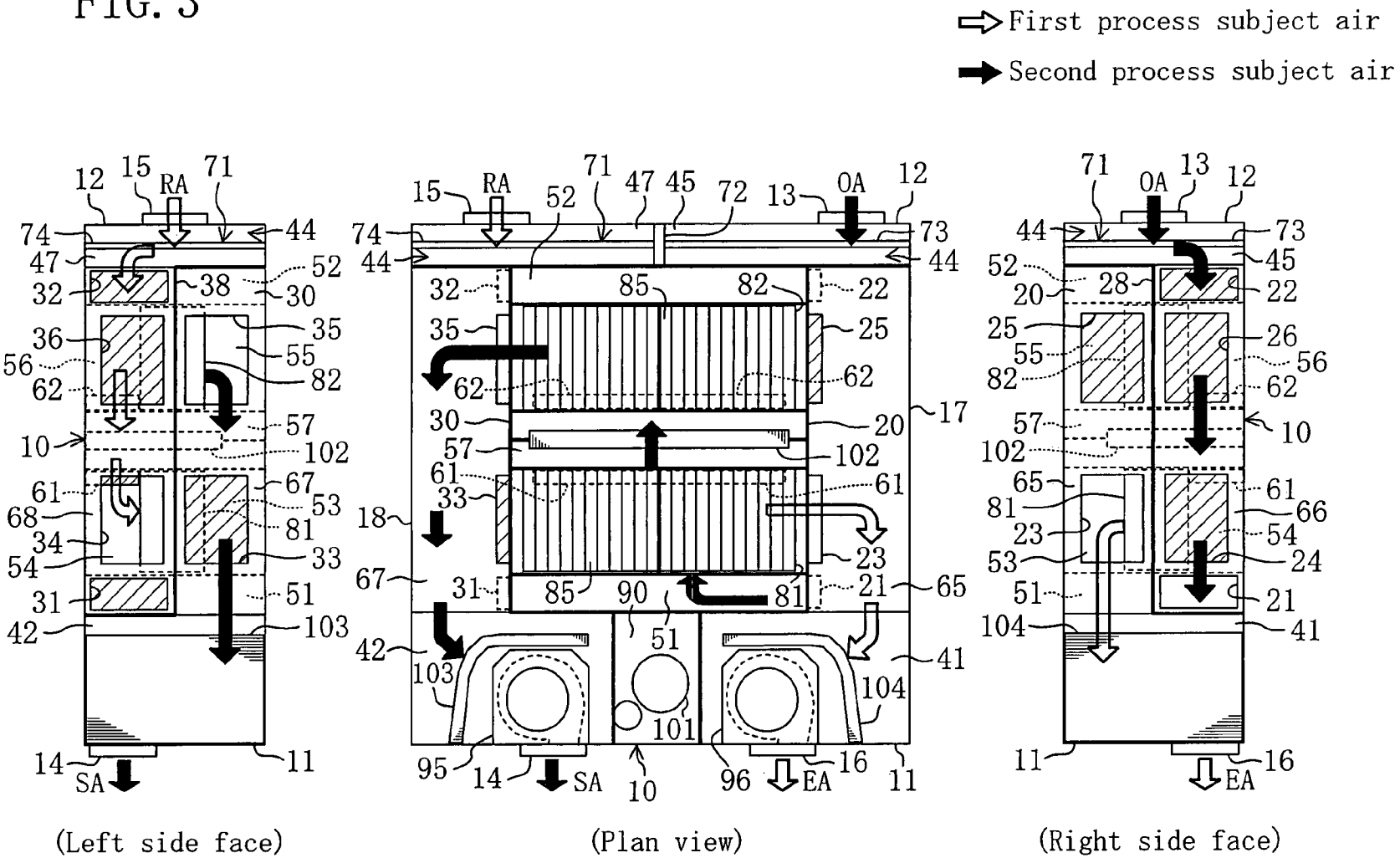
FIG. 3 shows the general structure of the humidity controller apparatus according to embodiment 1 and streams of air in a first operation of humidification operation.
Figure 4:
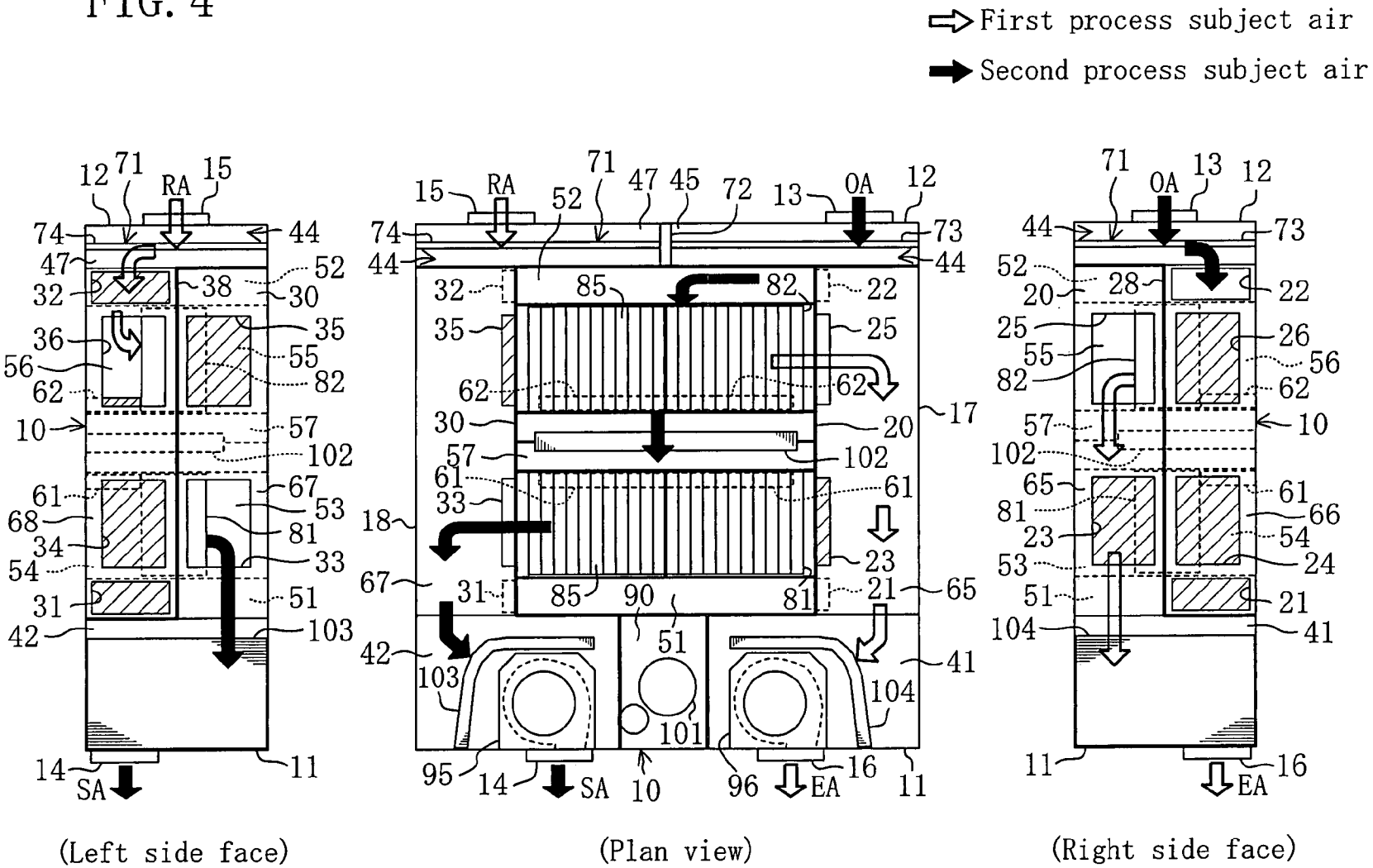
FIG. 4 shows the general structure of the humidity controller apparatus according to embodiment 1 and streams of air in a second operation of humidification operation.

As shown in FIG. 3 and FIG. 4, in the humidification operation, when the first outlet fan (95) is driven, outdoor air (OA) is introduced into the casing (10) through the first inlet opening (13). The outdoor air flows as second process subject air into the suction side right flow path (45). The second process subject air is filtered by the first filter portion (73) of the air filter (71). When the second outlet fan (96) is driven, indoor air (RA) is introduced into the casing (10) through the second inlet opening (15). The indoor air flows as first process subject air into the suction side left flow path (47). The first process subject air is filtered by the second filter portion (74) of the air filter (71).

Since the filter room (44) is separated by the partition (72) of the air filter (71) into two parts, the outdoor air introduced through the first inlet opening (13) and the indoor air introduced through the second inlet opening (15) do not mix with each other.

In the humidification operation, in the refrigerant circuit, the regeneration heat exchanger (102) functions as a condenser, and the second heat exchanger (104) functions as an evaporator, while the first heat exchanger (103) is at rest.

The first operation of the humidification operation is described with reference to FIG. 3, FIG. 5A, and FIG. 5B. In the first operation, an adsorption process with the first adsorption element (81) and a regeneration process with the second adsorption element (82) are performed. That is, in the first operation, the moisture is added to air by the second adsorption element (82) while the adsorbent material of the first adsorption element (81) adsorbs water vapor.

As shown in FIG. 3, in the right partition (20), the first right side opening (21) and the first right upper opening (23) allow communication therethrough, while the other openings (22, 24, 25, 26) are closed. In the left partition (30), the first left lower opening (34) and the second left upper opening (35) allow communication therethrough, while the other openings (31, 32, 33, 36) are closed. The first shutter (61) is closed, while the second shutter (62) is open.

The first process subject air flows from the suction side left flow path (47) to the left lower flow path (68). Thereafter, the first process subject air passes through the first left lower opening (34) to flow into the first lower flow path (54). Meanwhile, the second process subject air flows from the suction side right flow path (45) to the right lower flow path (66). Thereafter, the second process subject air passes through the first right side opening (21) to flow into the first flow path (51).

As also shown in FIG. 5A, the first process subject air of the first lower flow path (54) then flows into the humidity control side paths (85) of the first adsorption element (81). While the first process subject air passes through the humidity control side paths (85), the water vapor contained in the first process subject air is adsorbed by the adsorbent material. The first process subject air whose moisture has been removed by the first adsorption element (81) then flows into the first upper flow path (53).

Meanwhile, the second process subject air of the first flow path (51) flows into the cooling side paths (86) of the first adsorption element (81). While passing through the cooling side paths (86), the second process subject air absorbs adsorption heat which has been produced through adsorption of the water vapor by the adsorbent material in the humidity control side paths (85). After having absorbed the adsorption heat, the second process subject air flows into the central flow path (57) and passes through the regeneration heat exchanger (102). In the regeneration heat exchanger (102), the second process subject air is heated through a heat exchange with the refrigerant. Thereafter, the second process subject air flows from the central flow path (57) into the second lower flow path (56).

The second process subject air heated by the first adsorption element (81) and the regeneration heat exchanger (102) is introduced to the humidity control side paths (85) of the second adsorption element (82). In the humidity control side paths (85), the adsorbent material is heated by the second process subject air so that water vapor is desorbed from the adsorbent material. That is, the second adsorption element (82) is regenerated. The water vapor desorbed from the absorbent material is given to the second process subject air, whereby moisture is added to the second process subject air. The second process subject air to which the moisture has been added by the second adsorption element (82) then flows into the second upper flow path (55).

As shown in FIG. 3, the second process subject air flowing into the second upper flow path (55) then passes through the second left upper opening (35) to flow into the left upper flow path (67). Thereafter, the second process subject air flows into the first outlet flow path (42). While flowing through the first outlet flow path (42), the second process subject air passes through the first heat exchanger (103). Since the first heat exchanger (103) is at rest, the second process subject air is not heated or cooled. Thereafter, the moisture-reduced second process subject air passes through the indoor side outlet duct (114) connected to the first outlet opening (14) to be supplied to the indoor space.

Meanwhile, the first process subject air flowing into the first upper flow path (53) then passes through the first right upper opening (23) to flow in the right upper flow path (65). Thereafter, the second process subject air flows into the second outlet flow path (41). While flowing through the second outlet flow path (41), the first process subject air passes through the second heat exchanger (104). In the second heat exchanger (104), the first process subject air is cooled through a heat exchange with the refrigerant. Then, the first process subject air, from which the moisture and heat have been removed, is expelled to the outdoor space through the outdoor side outlet duct (116) connected to the second outlet opening (16).

The second operation of humidification operation is described with reference to FIG. 4, FIG. 5A, and FIG. 5B. In the second operation, contrary to the first operation, an adsorption process with the second adsorption element (82) and a regeneration process with the first adsorption element (81) are performed. That is, in the second operation, the moisture is added to air by the first adsorption element (81) while the adsorbent material of the second adsorption element (82) absorbs water vapor.

As shown in FIG. 4, in the right partition (20), the second right side opening (22) and the second right upper opening (25) allow communication therethrough, while the other openings (21, 23, 24, 26) are closed. In the left partition (30), the first left upper opening (33) and the second left lower opening (36) allow communication therethrough, while the other openings (31, 32, 34, 35) are closed. The second shutter (62) is closed, while the first shutter (61) is open.

The first process subject air flows from the suction side left flow path (47) to the left lower flow path (68). Thereafter, the first process subject air passes through the second left lower opening (36) to flow into the second lower flow path (56). Meanwhile, the second process subject air flows from the suction side right flow path (45) to the right lower flow path (66). Thereafter, the second process subject air passes through the second right side opening (22) to flow into the second flow path (52).

As also shown in FIG. 5B, the first process subject air of the second lower flow path (56) then flows into the humidity control side paths (85) of the second adsorption element (82). While the first process subject air passes through the humidity control side paths (85), the water vapor contained in the first process subject air is adsorbed by the adsorbent material. The first process subject air whose moisture has been removed by the second adsorption element (82) then flows into the second upper flow path (55).

Meanwhile, the second process subject air of the second flow path (52) then flows into the cooling side paths (86) of the second adsorption element (82). While passing through the cooling side paths (86), the second process subject air absorbs adsorption heat which has been produced through adsorption of the water vapor by the adsorbent material in the humidity control side paths (85). After having absorbed the adsorption heat, the second process subject air flows into the central flow path (57) and passes through the regeneration heat exchanger (102). In the regeneration heat exchanger (102), the second process subject air is heated through a heat exchange with the refrigerant. Thereafter, the second process subject air flows from the central flow path (57) into the first lower flow path (54).

The second process subject air heated by the second adsorption element (82) and the regeneration heat exchanger (102) is introduced to the humidity control side paths (85) of the first adsorption element (81). In the humidity control side paths (85), the adsorbent material is heated by the second process subject air so that water vapor is desorbed from the adsorbent material. That is, the first adsorption element (81) is regenerated. The water vapor desorbed from the absorbent material is given to the second process subject air, whereby moisture is added to the second process subject air. The second process subject air to which the moisture has been added by the first adsorption element (81) then flows into the first upper flow path (53).

As shown in FIG. 4, the second process subject air flowing into the first upper flow path (53) then passes through the first left upper opening (33) to flow into the left upper flow path (67). Thereafter, the second process subject air flows into the first outlet flow path (42). While flowing through the first outlet flow path (42), the second process subject air passes through the first heat exchanger (103). Since the first heat exchanger (103) is at rest, the second process subject air is not heated or cooled. Thereafter, the moisture-added second process subject air passes through the indoor side outlet duct (114) connected to the first outlet opening (14) to be supplied to the indoor space.

Meanwhile, the first process subject air flowing into the second upper flow path (55) then passes through the second right upper opening (25) to flow in the right upper flow path (65). Thereafter, the first process subject air flows into the second outlet flow path (41). While flowing through the second outlet flow path (41), the first process subject air passes through the second heat exchanger (104). In the second heat exchanger (104), the first process subject air is cooled through a heat exchange with the refrigerant. Then, the first process subject air, from which the moisture and heat have been removed, is expelled to the outdoor space through the outdoor side outlet duct (116) connected to the second outlet opening (16).

Maintenance

Next, a maintenance method of the humidity controller apparatus of this embodiment is described. As shown in FIG. 8 and FIG. 9, in order to remove the air filter (71) out of the humidity controller apparatus, a maintenance person opens the second inspection manhole (H2), whereby his/her maintenance tasks at the fourth panel (18) of the humidity controller apparatus are enabled. When the filter inspection lid (131) of the fourth panel (18) is detached from the casing (10), the air filter (71) fixed onto the inner surface of the filter inspection lid (131) is slid together with the filter inspection lid (131), whereby the air filter (71) is removed out of the casing (10) together with the filter inspection lid (131).

The first adsorption element (81) and the second adsorption element (82) can be removed by detaching the element inspection lid (132) from the fourth panel (18) and taking the first adsorption element (81) and the second adsorption element (82) out of the casing (10).

To take out the fans (95, 96) or the compressor (101), the maintenance person opens the first inspection manhole (H1), whereby his/her maintenance tasks at the first panel (11) of the humidity controller apparatus are enabled. After the fan inspection lid (121) of the first panel (11) is detached from the casing (10), the first outlet fan (95), the second outlet fan (96), and the compressor (101) are taken out through the opening of the casing (10).

Effects of Embodiment 1

In the humidity controller apparatus of this embodiment, the second panel (12) of the casing (10) has the first and second inlet openings (13, 15) which are provided side by side. The air filter (71) is provided in the filter room (44) which is in communication with the first and second inlet openings (13, 15). Thus, the air filter (71) for filtering the process subject air introduced through the first and second inlet openings (13, 15) can be intensively provided at one place in the casing (10). Therefore, the number of steps for the tasks of pulling the air filter (71) out of the casing (10) and pushing the air filter (71) back into the casing (10) can be reduced. Thus, in the humidity controller apparatus according to this embodiment, the workability of the maintenance tasks for the air filter (71) is improved, while the process subject air is filtered by the air filter (71) provided immediately next to the inlet openings (13, 15), whereby the amount of dusts, and the like, introduced into the casing (10) is reduced.

In the humidity controller apparatus of this embodiment, both the process subject air flowing from the first inlet opening (13) into the casing (10) and the process subject air flowing from the second inlet opening (15) into the casing (10) are filtered by the air filter (71). Thus, in a maintenance process of the air filter (71), only one piece of this air filter is detached from and attached to the casing (10). Therefore, the workability of the maintenance tasks for the air filter (71) is further improved. In the humidity controller apparatus of this embodiment, the partition (72) is attached to the air filter (71). The streams of air introduced through the inlet openings (13, 15) into the casing (10) are filtered by one air filter (71) while being prevented from mixing with each other.

In the humidity controller apparatus of this embodiment, the fourth panel (18) of the casing (10), which is adjacent to the second panel (12), has the filter inspection lid (131) with which the air filter (71) can be taken out. Thus, the air filter (71) can be taken out only by opening one filter inspection lid (131). Therefore, the workability of the maintenance tasks for the air filter (71) is further improved.

In the humidity controller apparatus of this embodiment, the air filter (71) is fixed onto the inner surface of the filter inspection lid (131). Thus, when the filter inspection lid (131) is opened, the air filter (71) is taken out of the casing (10) along with the movement of the filter inspection lid (131). Therefore, the number of steps of the maintenance tasks for the air filter (71) can be reduced.

Variations of Embodiment 1

In the above example, only the fourth panel (18) is provided with the filter inspection lid (131) and the element inspection lid (132). However, the filter inspection lid (131) and the element inspection lid (132) may be provided to only the third panel (17). In this case, the second inspection manhole (H2) is provided in the vicinity of the third panel (17).

Alternatively, the filter inspection lid (131) and the element inspection lid (132) may be provided not only to the fourth panel (18) but also the third panel (17). With this structure, the air filter (71) and the adsorption element (81, 82) can be removed out of the casing (10) through any of the fourth panel (18) and the third panel (17) according to the installation state of the humidity controller apparatus.

For example, as shown in FIG. 7, if the third panel (17) is in the vicinity of the wall (W), the left end of the air filter (71) is fixed to the inner surface of the filter inspection lid (131) of the fourth panel (18) on the other side. If, contrary, the fourth panel (18) is in the vicinity of the wall (W), the right end of the air filter (71) is fixed to the inner surface of the filter inspection lid (131) of the third panel (17) on the other side. That is, a manhole is provided on the other side of the wall (W), such that the maintenance tasks for the air filter (71) and the adsorption element (81, 82) can be carried out through the manhole. Therefore, the humidity controller apparatus can be installed in the vicinity of the wall (W).

In the humidity controller apparatus of this embodiment, the first filter portion (73) and the second filter portion (74) of the air filter (71) may be formed of different filter base materials. Flowing into the suction side left flow path (47) is indoor air, while flowing into the suction side right flow path (45) is outdoor air. That is, the first filter portion (73) of the suction side right flow path (45) filters dirtier air than the second filter portion (74) of the suction side left flow path (47) does. Thus, it is desirable that the filter base material of the first filter portion (73) has higher collection efficiency than the filter base material of the second filter portion (74) has.

Embodiment 2

Embodiment 2 of the present invention is described.

Figure 10:
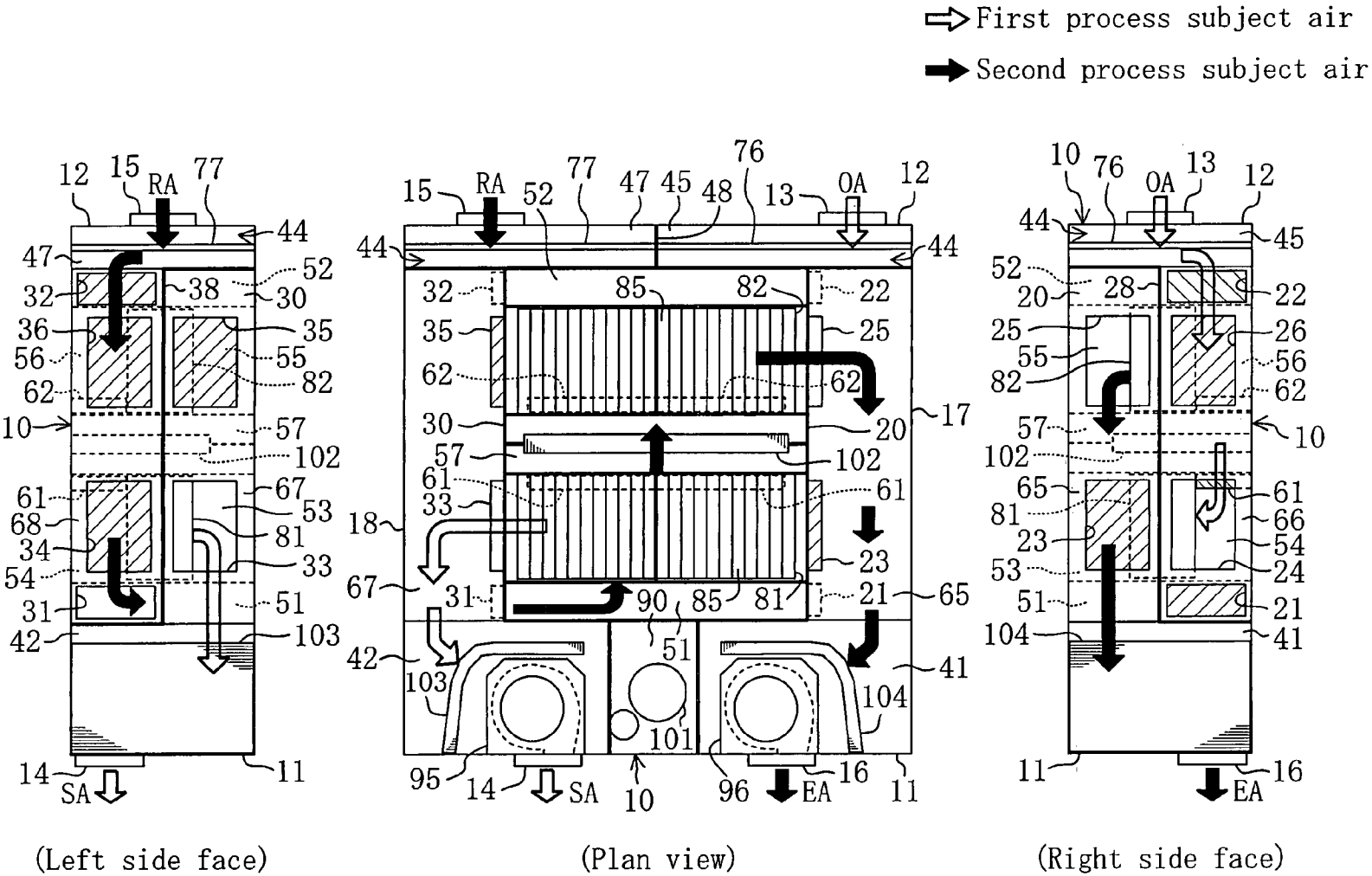
FIG. 10 shows a general structure of a humidity controller apparatus according to embodiment 2 and streams of air in a first operation of dehumidification operation.

As shown in FIG. 10, a humidity controller apparatus of embodiment 2 of the present invention is different from the humidity controller apparatus of embodiment 1 in that a filter room (44), which is provided near the second panel (12) of the casing (10), is partitioned by a partition (48) into right and left parts, and the right and left parts of the filter room (44) are provided with air filters (76, 77), respectively, on a one-to-one basis. In this embodiment, the same elements as those of FIG. 1 to FIG. 9 are denoted by the same reference numerals, and the descriptions thereof are herein omitted.

The partition (48) is attached to the casing (10). The right part of the filter room (44) constitutes a suction side right flow path (45) (first portion). The suction side right flow path (45) is in communication with the first inlet opening (13). The left part of the filter room (44) constitutes a suction side left flow path (47) (second portion). The suction side left flow path (47) is in communication with the second inlet opening (15).

The suction side right flow path (45) and the suction side left flow path (47) separated by the partition (48) are provided with air filters (76, 77), respectively, on a one-to-one basis. Specifically, the first air filter (76) is provided in the suction side right flow path (45), and the second air filter (77) is provided in the suction side left flow path (47).

Figure 12:
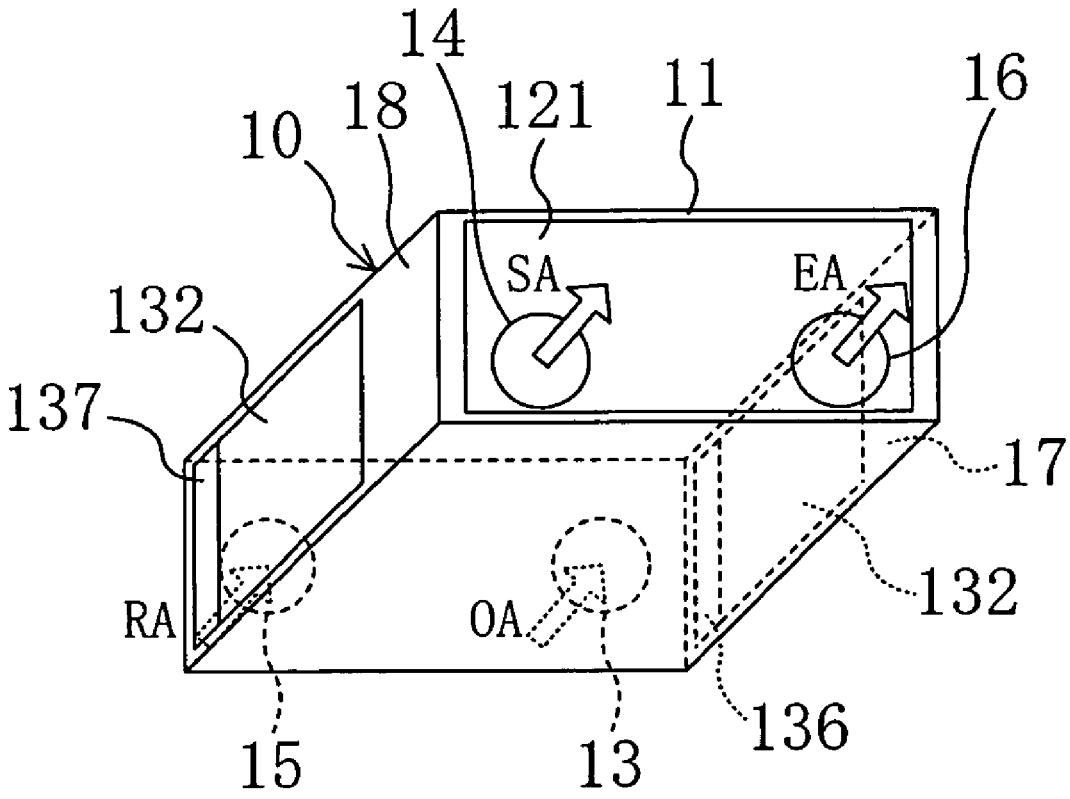
FIG. 12 is a general perspective view showing the positions of inspection hole lids of the humidity controller apparatus of embodiment 2.
Figure 13:
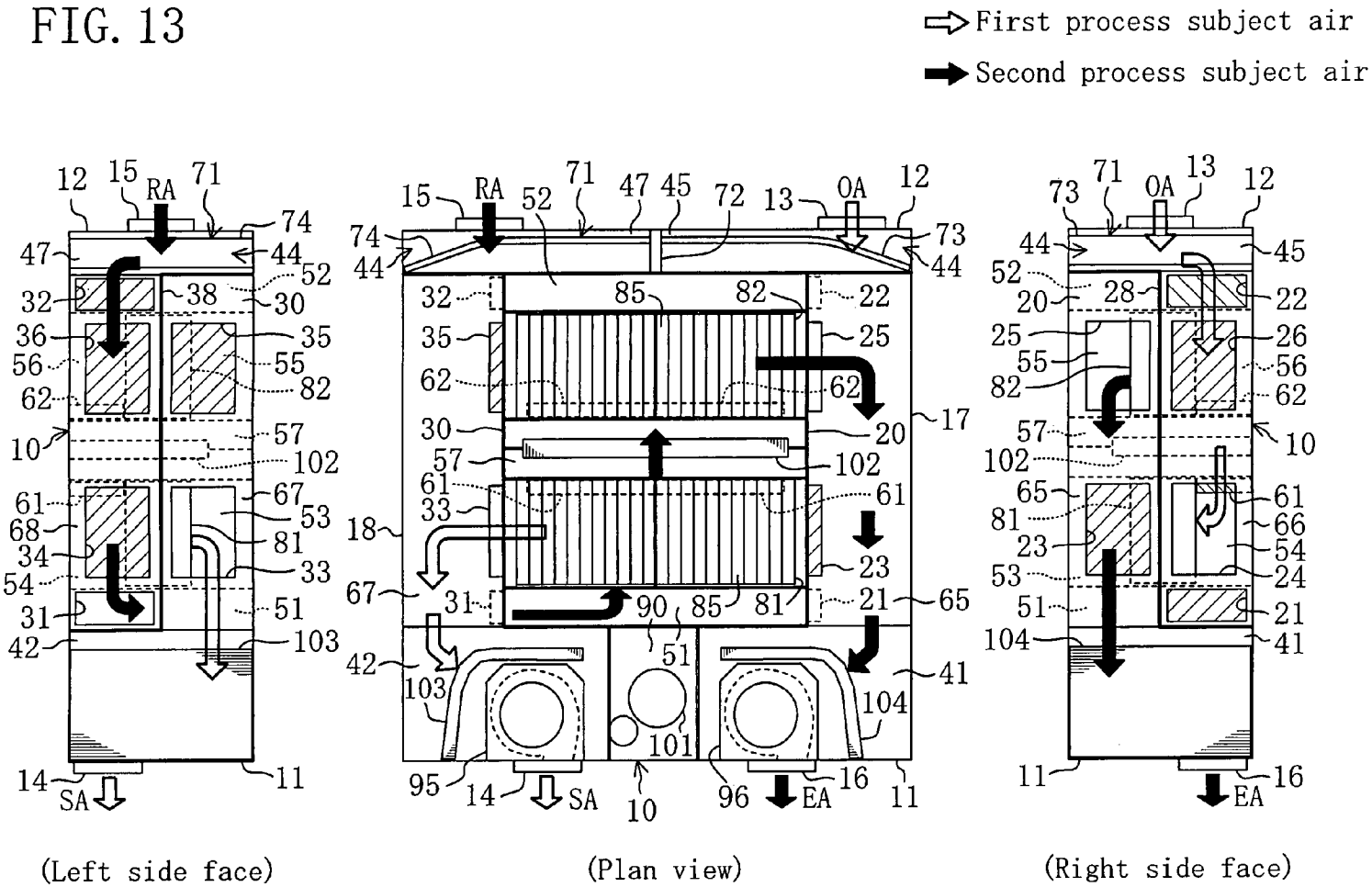
FIG. 13 shows a general structure of a humidity controller apparatus according to another embodiment and streams of air in a first operation of dehumidification operation.

As shown in FIG. 12, the third panel (17) has a first filter inspection lid (136) and an element inspection lid (132), both of which are detachable from the casing (10). The fourth panel (18) has a second filter inspection lid (137) and an element inspection lid (132), both of which are detachable from the casing (10). It should be noted that the element inspection lid (132) may be provided to only any one of the third panel (17) and the fourth panel (18).

The air filters (76, 77) are attached to the inner surfaces of the filter inspection lids (136, 137), respectively. Specifically, an end of the first air filter (76) is fixed to the inner surface of the first filter inspection lid (136). An end of the second air filter (77) is fixed to the inner surface of the second filter inspection lid (137).

The respective operations of the humidity controller apparatus of this embodiment are totally the same as those of the humidity controller apparatus of embodiment 1 as seen from FIG. 10 where an example of the first operation of the dehumidification operation is illustrated. Therefore, the descriptions of the operations are herein omitted.

Maintenance

Figure 11:
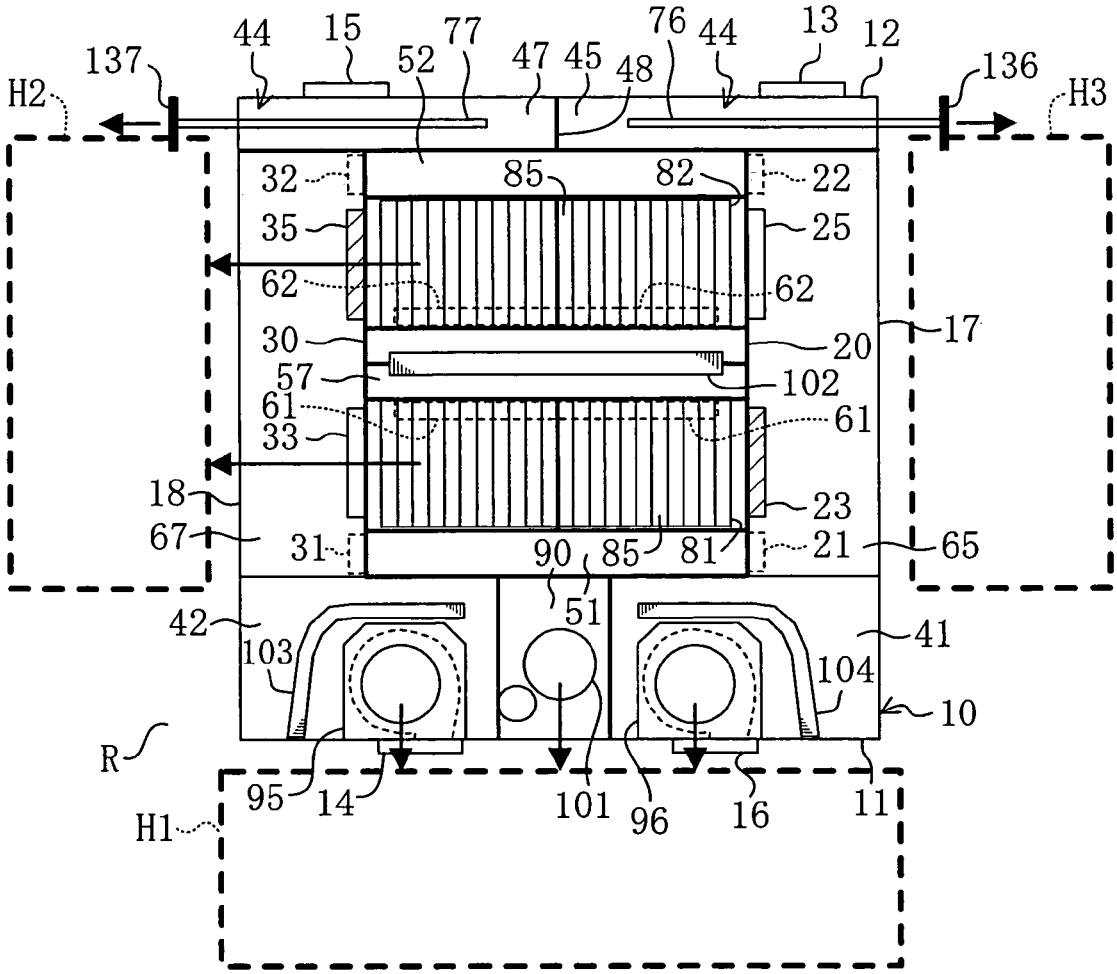
FIG. 11 is a general plan view illustrating by arrows the direction in which a device is pulled out at the time of maintenance in the humidity controller apparatus of embodiment 2.

Next, a maintenance method of the humidity controller apparatus of this embodiment is described. As shown in FIG. 11, in order to remove the second air filter (77) provided near the fourth panel (18), a maintenance person opens the second inspection manhole (H2), whereby his/her maintenance tasks at the fourth panel (18) of the humidity controller apparatus are enabled. When the second filter inspection lid (137) of the fourth panel (18) is detached from the casing (10), the second air filter (77) is slid to the left together with the second filter inspection lid (137), whereby the second air filter (77) is pulled out of the casing (10).

In order to remove the first air filter (76) provided near the third panel (17), a maintenance person opens the third inspection manhole (H3), whereby his/her maintenance tasks at the third panel (17) of the humidity controller apparatus are enabled. When the first filter inspection lid (136) of the third panel (17) is detached from the casing (10), the first air filter (76) is slid to the right together with the first filter inspection lid (136), whereby the first air filter (76) is pulled out of the casing (10).

The first adsorption element (81) and the second adsorption element (82) can be removed by detaching the element inspection lid (132) from any one of the fourth panel (18) and the third panel (17) and taking the first adsorption element (81) and the second adsorption element (82) out of the casing (10).

Variations of Embodiment 2

In the humidity controller apparatus of this embodiment, the first air filter (76) and the second air filter (77) may be formed of different filter base materials. Flowing into the suction side left flow path (47) is indoor air, while flowing into the suction side right flow path (45) is outdoor air. That is, the first air filter (76) of the suction side right flow path (45) filters dirtier air than the second air filter (77) of the suction side left flow path (47) does. Thus, it is desirable that the filter base material of the first air filter (76) has higher collection efficiency than the filter base material of the second air filter (77) has. Alternatively, the first air filter (76), which is more likely to be smudged, may be formed of two filter base materials superposed on each other.

Other Embodiments

Although in the humidity controller apparatuses of embodiments 1 and 2 the air filter (71) is provided along the second panel (12), the air filter (71) may have the shape of an arc when seen in the top view. With such a shape, the air resistance of the air filter (71) is decreased.

Although not shown, the air filter (71) may be slanted at an angle with the second panel (12) such that the lower edge of the air filter (71) is in contact with the second panel (12) while the upper edge of the air filter (71) inclines toward the adsorption elements (81, 82). With such an arrangement, the air resistance of the air filter (71) is also decreased.

INDUSTRIAL APPLICABILITY

As described above, the present invention is useful for a humidity controller apparatus for controlling the humidity of air.

The invention claimed is:

1. A humidity controller apparatus for removing moisture from or adding moisture to process subject air alternately using a first adsorption element (81) and a second adsorption element (82) by distributing first and second process subject air in a hollow casing (10) with first and second fans (95, 96) and switching distribution routes for the process subject air in the casing (10), wherein:

the casing (10) has a flat rectangular shape and has first and second inlet openings (13, 15) and first and second outlet openings (14, 16);

a suction-side wall (12), which is one of side walls of the casing (10), has the first and second inlet openings (13, 15) which are provided side by side in a longitudinal direction of the suction-side wall (12);

the casing (10) has a filter room (44) extending along the suction-side wall (12), the filter room (44) being in communication with the first and second inlet openings (13, 15); and the filter room (44) contains an air filter (71, 76, 77) for filtering process subject air introduced through the inlet openings (13, 15).

2. A humidity controller apparatus for removing moisture from or adding moisture to process subject air alternately using a first adsorption element (81) and a second adsorption element (82) by distributing first and second process subject air in a hollow casing (10) with first and second fans (95, 96) and switching distribution routes for the process subject air in the casing (10), wherein:

the casing (10) has a flat rectangular shape and has first and second inlet openings (13, 15) and first and second outlet openings (14, 16);

a suction-side wall (12), which is one of side walls of the casing (10), has the first and second inlet openings (13, 15) which are provided side by side in a longitudinal direction of the suction-side wall (12); and the casing (10) contains an air filter (71, 76, 77) along the suction-side wall (12) for filtering process subject air introduced through the inlet openings (13, 15).

3. The humidity controller apparatus of claim 1, wherein the filter room (44) contains an air filter (71) for filtering the process subject air introduced through the inlet openings (13, 15), and the air filter (71) has a partitioning member (72) for partitioning the filter room (44) into a first portion (45) which is in communication with the first inlet opening (13) and a second portion (47) which is in communication with the second inlet opening (15).

4. The humidity controller apparatus of claim 2, wherein the air filter (71) includes a first filter portion (73) for filtering process subject air introduced through the first inlet opening (13), a second filter portion (74) for filtering process subject air introduced through the second inlet opening (15), and a partitioning member (72) for preventing air passing through the first filter portion (73) and air passing through the second filter portion (74) from mixing with each other, the first filter portion (73), the second filter portion (74), and the partitioning member (72) being integrally formed.

5. The humidity controller apparatus of claim 3 or 4, wherein at least one of side walls of the casing (10) which are adjacent to the suction-side wall (12) has a filter inspection lid (131) for allowing the air filter (71) to be removed out of the casing (10).

6. The humidity controller apparatus of claim 5, wherein the air filter (71) is attached onto an inner surface of the filter inspection lid (131).

7. The humidity controller apparatus of claim 3 or 4, wherein the air filter (71) is detachable from the casing (10) by being slid in a direction parallel to the suction-side wall (12).

8. The humidity controller apparatus of claim 1, wherein:

the filter room (44) is partitioned into a first portion (45) which is in communication with the first inlet opening (13) and a second portion (47) which is in communication with the second inlet opening (15); and the first portion (45) contains a first air filter (76), and the second portion (47) contains a second air filter (77).

9. The humidity controller apparatus of claim 2, wherein the casing (10) contains a first air filter (76) for filtering process subject air introduced through the first inlet opening (13) and a second air filter (77) for filtering process subject air introduced through the second inlet opening (15).

10. The humidity controller apparatus of claim 8 or 9, wherein the casing (10) has a pair of side walls which face each other and are adjacent to the suction-side wall (12), each of the pair of side walls having a filter inspection lid (136, 137) which allows an air filter (76, 77) to be removed out of the casing (10).

11. The humidity controller apparatus of claim 8 or 9, wherein the casing (10) has side walls adjacent to the suction-side wall (12), the side walls including a pair of side walls which face each other, one of the pair of side walls having a first filter inspection lid (136) which allows the first air filter (76) to be removed out of the casing (10), and the other of the pair of side walls having a second filter inspection lid (137) which allows the second air filter (77) to be removed out of the casing (10).

12. The humidity controller apparatus of claim 11, wherein the first air filter (76) is attached onto an inner surface of the first filter inspection lid (136), and the second air filter (77) is attached onto an inner surface of the second filter inspection lid (137).

13. The humidity controller apparatus of claim 8 or 9, wherein each of the air filters (76, 77) is detachable from the casing (10) by being slid in a direction parallel to the suction-side wall (12).

* * * * *